US009734776B2

(12) United States Patent
Uehara

(10) Patent No.: US 9,734,776 B2
(45) Date of Patent: Aug. 15, 2017

(54) DISPLAY DEVICE, TEMPERATURE INFORMATION ACQUIRING DEVICE, AND TEMPERATURE INFORMATION ACQUIRING METHOD

(71) Applicant: Japan Display Inc., Tokyo (JP)

(72) Inventor: Toshinori Uehara, Tokyo (JP)

(73) Assignee: Japan Display Inc., Tokyo (JP)

( * ) Notice: Subject to any disclaimer, the term of this patent is extended or adjusted under 35 U.S.C. 154(b) by 74 days.

(21) Appl. No.: 14/677,367

(22) Filed: Apr. 2, 2015

(65) Prior Publication Data

US 2015/0287371 A1 Oct. 8, 2015

(30) Foreign Application Priority Data

Apr. 4, 2014 (JP) ..... 2014-078122

(51) Int. Cl.
*G09G 5/10* (2006.01)
*G09G 3/36* (2006.01)

(52) U.S. Cl.
CPC ..... *G09G 3/3611* (2013.01); *G09G 2320/041* (2013.01); *G09G 2330/045* (2013.01)

(58) Field of Classification Search
CPC ..... G09G 3/3611; G09G 2320/0606; G09G 2320/041
USPC ..... 345/690
See application file for complete search history.

(56) References Cited

U.S. PATENT DOCUMENTS

2007/0012897 A1* 1/2007 Lee ..... G02F 1/133382 252/299.1
2008/0122829 A1* 5/2008 Park ..... G09G 3/3677 345/213
2010/0277519 A1* 11/2010 Lee ..... G09G 3/3406 345/691
2011/0109655 A1* 5/2011 Takeda ..... G02F 1/133602 345/690
2013/0027344 A1* 1/2013 Choon ..... G06F 3/044 345/174

(Continued)

FOREIGN PATENT DOCUMENTS

JP 2011-099879 A 5/2011
JP 2013-091298 A 5/2013

*Primary Examiner* — Michael Pervan
*Assistant Examiner* — Andrew Lee
(74) *Attorney, Agent, or Firm* — Michael Best & Friedrich LLP

(57) ABSTRACT

A display device includes a display unit that displays an image, an illuminating unit that irradiates light to the display unit, a plurality of electrodes that are arranged on the display unit, an applying unit that applies an electric signal to the electrodes, a detecting unit that detects electrical changes of the electrodes occurring due to the electric signal, and a control unit that controls the display unit or the illuminating unit based on temperature information of the electrodes indicated by the electrical changes. Each of the electrodes includes a plurality of extension portions, and a coupling portion that couples one ends of the extension portions. A longitudinal direction of each of the extension portions is along the other direction perpendicular to the one direction. The control unit controls the display unit or the illuminating unit based on a temperature distribution of each of the electrodes in the other direction.

19 Claims, 29 Drawing Sheets

(56) References Cited

U.S. PATENT DOCUMENTS

| | | | | |
|---|---|---|---|---|
| 2014/0139570 | A1* | 5/2014 | Albrecht | G09G 5/06 345/694 |
| 2014/0232959 | A1 | 8/2014 | Kuriki | |

* cited by examiner

DISPLAY DEVICE, TEMPERATURE INFORMATION ACQUIRING DEVICE, AND TEMPERATURE INFORMATION ACQUIRING METHOD

CROSS-REFERENCE TO RELATED APPLICATIONS

This application claims priority from Japanese Application No. 2014-078122, filed on Apr. 4, 2014, the contents of which are incorporated by reference herein in its entirety.

BACKGROUND

1. Technical Field

The present disclosure relates to a display device, a temperature information acquiring device, and a temperature information acquiring method.

2. Description of the Related Art

In a general liquid crystal display as a display device, response characteristics at the time of operation are changed by temperature. Therefore, a method of controlling an operation of a liquid crystal display according to the temperature detected by a temperature sensor that detects an ambient temperature of the liquid crystal display has been known (see Japanese Patent Application Laid-open Publication No. 2011-099879 (JP-A-2011-099879)).

In the liquid crystal display, when there is a portion reaching a high temperature of a predetermined level or higher in a display area, a display defect may occur in the portion due to the characteristics of the liquid crystal. For example, if part or whole of the liquid crystal display exceeds 100° C. by irradiation of sunlight or the like, a display defect may occur, such that a display content at the portion may be disturbed or the content cannot be displayed. Related to a problem caused by the temperature, there is a desire to detect a temperature of a surface such as a display surface of the liquid crystal display. However, the temperature of the surface cannot be detected by using the method described in JP-A-2011-099879.

For the foregoing reasons, there is a need for a display device, a temperature information acquiring device and a temperature information acquiring method that can detect the temperature of the surface.

SUMMARY

According to an aspect, a display device includes: a display unit that displays an image; an illuminating unit that irradiates light to the display unit; a plurality of electrodes that are arranged on the display unit; an applying unit that applies an electric signal to the electrodes; a detecting unit that detects electrical changes of the electrodes occurring due to the electric signal; and a control unit that controls the display unit or the illuminating unit based on temperature information for the electrodes indicated by the electrical changes. Each of the electrodes includes: a plurality of extension portions provided in parallel at an interval in a predetermined one direction; and a coupling portion that couples one ends of the extension portions, and a longitudinal direction of each of the extension portions is along the other direction close to the one direction. The control unit controls the display unit or the illuminating unit based on a temperature distribution of each of the electrodes in the other direction.

According to another aspect, a temperature information acquiring device includes: a plurality of electrodes; an applying unit that applies an electric signal to the electrodes; a detecting unit that detects electrical changes of the electrodes occurring due to the electric signal; and a specifying unit that specifies temperature information for each of the electrodes based on the electrical changes. Each of the electrodes includes: a plurality of extension portions provided in parallel at an interval in a predetermined one direction; and a coupling portion that couples one ends of the extension portions. A longitudinal direction of each of the extension portions is along the other direction perpendicular to the one direction.

According to still another aspect, a temperature information acquiring method includes: applying an electric signal to a plurality of electrodes; detecting electrical changes of the electrodes occurring due to the electric signal; and specifying temperature information for each of the electrodes based on the electrical changes. Each of the electrodes includes: a plurality of extension portions provided in parallel at an interval in a predetermined one direction; and a coupling portion that couples one ends of the extension portions. A longitudinal direction of each of the extension portions is along the other direction perpendicular to the one direction.

BRIEF DESCRIPTION OF THE DRAWINGS

FIG. 28 is an enlarged diagram of integration of the voltage waveform, of the integration of the voltage waveform illustrated in FIG. 23, after 180 μs to 210 μs since the start of pulse-on;

FIG. 29 is an enlarged diagram of integration of the voltage waveform, of the integration of the voltage waveform illustrated in FIG. 24, after 180 μs to 210 μs since the start of pulse-on;

DETAILED DESCRIPTION

Figure 1:
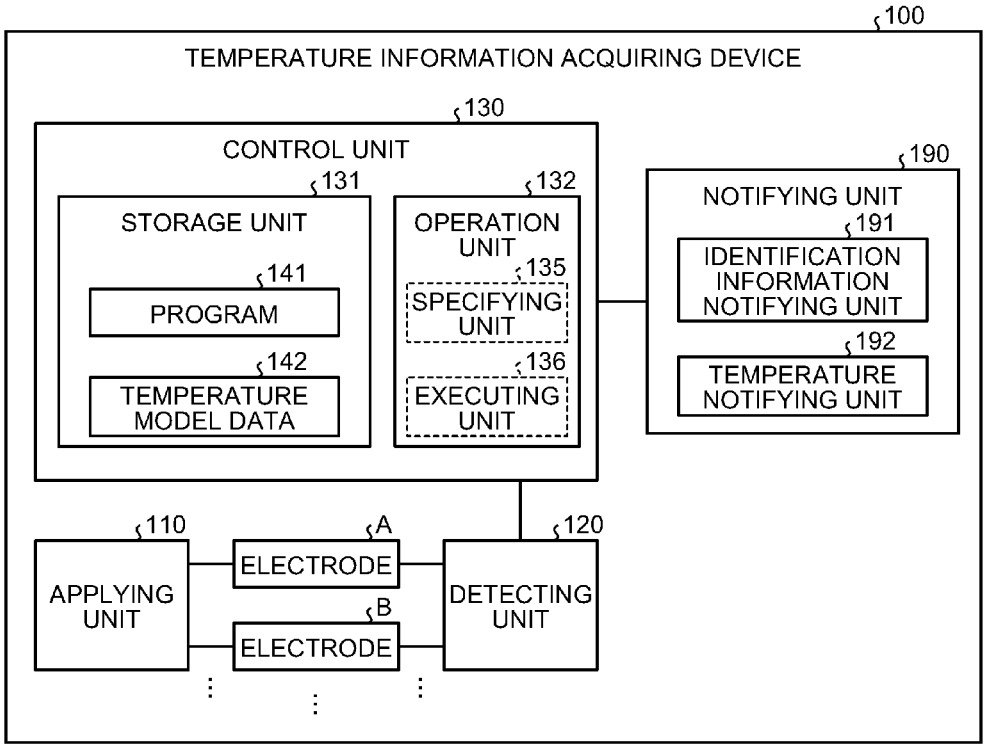
FIG. 1 is a block diagram of a configuration related to main functions of a temperature information acquiring device according to a first embodiment.

Exemplary embodiments of the present invention will be explained below with reference to the accompanying drawings. The disclosure is only an example, and therefore modifications within the gist of the invention which can be easily thought of by persons skilled in the art are obviously included in the scope of the present invention. Moreover, the widths, the thicknesses, the shapes, and the like of units in the drawings may be schematically represented as compared with those of actual aspects for the sake of clearer description. However, these representations are only examples, and therefore the interpretation of the present invention is not limited thereby. In the present specification and the figures, the same reference signs are assigned to the same elements as those in already described figures, and detailed explanation may be omitted if unnecessary.

The explanation will be performed in the following order.

1. First Embodiment
2. Second Embodiment
3. Third Embodiment
4. Application Examples
5. Other 1. First Embodiment First of all, a first embodiment of the present invention will be explained below with reference to FIG. 1 to FIG. 8. In the following explanation, a predetermined one direction along a plane such as a display surface of a liquid crystal display is set as an X direction, a direction along the plane and perpendicular to the X direction is set as a Y direction, and a direction perpendicular to the X direction and the Y direction is set as a Z direction.

FIG. 1 is a block diagram of a configuration related to main functions of a temperature information acquiring device 100 according to the first embodiment. As illustrated in FIG. 1, the temperature information acquiring device 100 includes a plurality of electrodes (e.g., electrodes A, B, C, D, E, F, G, H, I, J), an applying unit 110, a detecting unit 120, a control unit 130, and a notifying unit 190.

Figure 2:
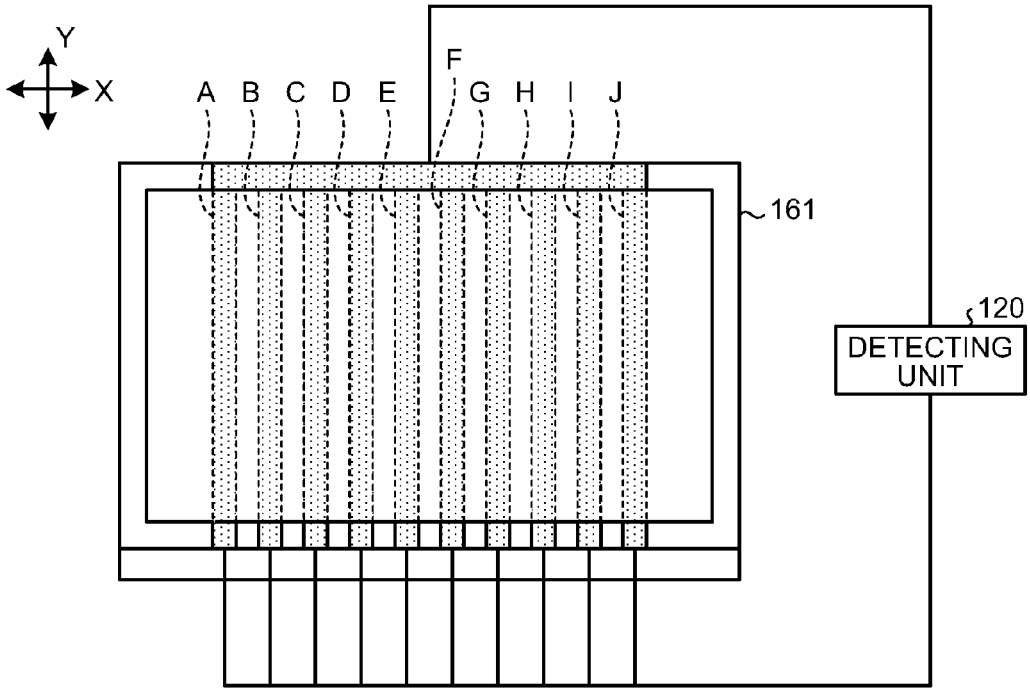
FIG. 2 is a diagram of an example of an arrangement of a plurality of electrodes and a coupling of a detecting unit coupled to the electrodes.

FIG. 2 is a diagram of an example of an arrangement of the electrodes A to J and a coupling of the detecting unit 120 coupled to the electrodes A to J. Specifically, the electrodes A to J are arranged in parallel in a predetermined one direction. In particular, the electrodes A to J are ten electrodes which are arranged in parallel in, for example, the X direction and whose longitudinal direction extends along the Y direction. The electrodes A to J are provided along the plane of a plate-shaped panel 161.

The applying unit 110 applies an electric signal to the electrodes A to J. Specifically, the applying unit 110 includes, for example, a circuit that outputs a predetermined pulse signal as an electric signal to the electrodes A to J and a controller that switches between states in which the pulse signal is output or not output by the circuit. The applying unit 110 is electrically coupled to the electrodes A to J and outputs the pulse signal to the electrodes A to J.

The detecting unit 120 detects an electrical change in each of the electrodes A to J occurring due to the electric signal. Specifically, the detecting unit 120 is a circuit that measures, for example, an electrical resistance value of each of the electrodes A to J. The detecting unit 120 measures resistance values of the electrodes A to J based on the current values flowing through the electrodes A to J or the voltage values of the electrodes A to J according to the pulse signal applied by the applying unit 110. The applying unit 110 and the detecting unit 120 are coupled to the electrodes A to J through, for example, switches for switching the electrodes A to J to be coupled; however, this configuration is an example, and therefore the embodiment is not limited thereto. Each of the electrodes A to J may be discretely provided with the applying unit 110 and the detecting unit 120.

The control unit 130 includes a storage unit 131 and an operation unit 132. The storage unit 131 is a storage device that stores program 141 and temperature model data 142. The program 141 is a program for executing a command based on the temperatures of the electrodes indicated by electrical changes detected by the detecting unit. The temperature model data 142 is data indicating a relationship between the electrical resistance values of the electrodes A to J and the temperatures of the electrodes A to J. More specifically, the temperature model data 142 is data indicating that when an electrical resistance value of one electrode is a certain electrical resistance value (for example, an electrical resistance value within a predetermined range), the one electrode has a certain temperature (for example, a temperature within a predetermined range or a predetermined temperature or less). In other words, by using the temperature model data 142, temperatures of the electrodes A to J can be calculated from the electrical resistance values of the electrodes A to J. In this way, the control unit 130 executes the program 141 and uses the electrical resistance values of the electrodes A to J detected by the detecting unit 120 and the temperature model data 142, and can thereby specify each temperature of the electrodes A to J from the electrical resistance value of each of the electrodes A to J and execute the command based on the specified temperature. Specifically, the operation unit 132 reads the program 141 from the storage unit 131 and executes the program, to function as a specifying unit 135 and an executing unit 136. The specifying unit 135 performs the calculation for specifying the temperature information corresponding to the electrical change (electrical resistance value) detected by the detecting unit 120. The executing unit 136 executes the command based on the temperatures of electrodes (for example, the temperatures specified by the specifying unit 135) indicated by the electrical changes of the electrodes. Specifically, the control unit 130 outputs identification information indicating an electrode at a highest temperature among the electrodes provided in, for example, the panel 161 and command to notify the temperature of the electrode to the notifying unit 190.

The notifying unit 190 operates under the control of the control unit 130 to notify the identification information indicating the electrode at the highest temperature among the electrodes and the temperature of the electrode. Specifically, the notifying unit 190 includes, for example, an identification information notifying unit 191 and a temperature notifying unit 192. The identification information notifying unit 191 indicates a position of the highest temperature in the panel 161 in the X direction using any one of signs of A to J. The temperature notifying unit 192 indicates the temperature of the electrode at the position indicated by the identification information notifying unit 191. Although the notifying unit 190 is formed with, for example, a plurality of 7-segment displays, this is only an example of the specific configuration of the notifying unit 190, and the embodiment is not limited thereto. The notifying unit 190 may perform the similar display by other display device, or may be configured to perform the similar notification using any method other than the display (for example, sound notification). In addition, the notifying unit 190 may be configured to simultaneously or selectively perform notification by the display or any method other than the display.

Figure 3:
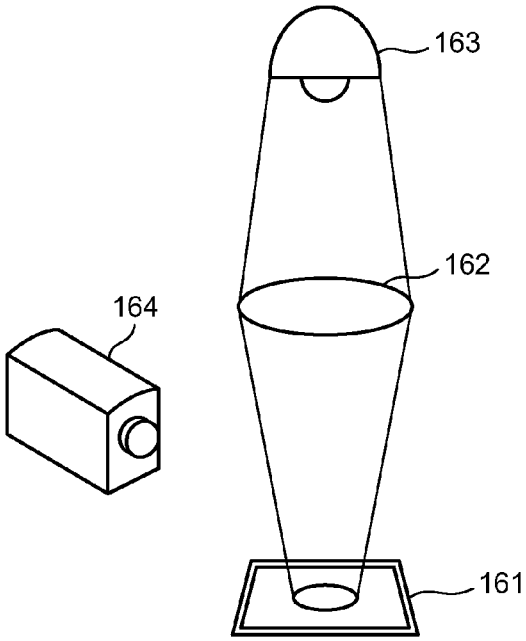
FIG. 3 is a diagram of an example of a configuration related to tests for measuring changes in electrical resistance values of the electrodes when a temperature at a portion of a panel is increased as compared with temperatures at the other portions.
Figure 4:
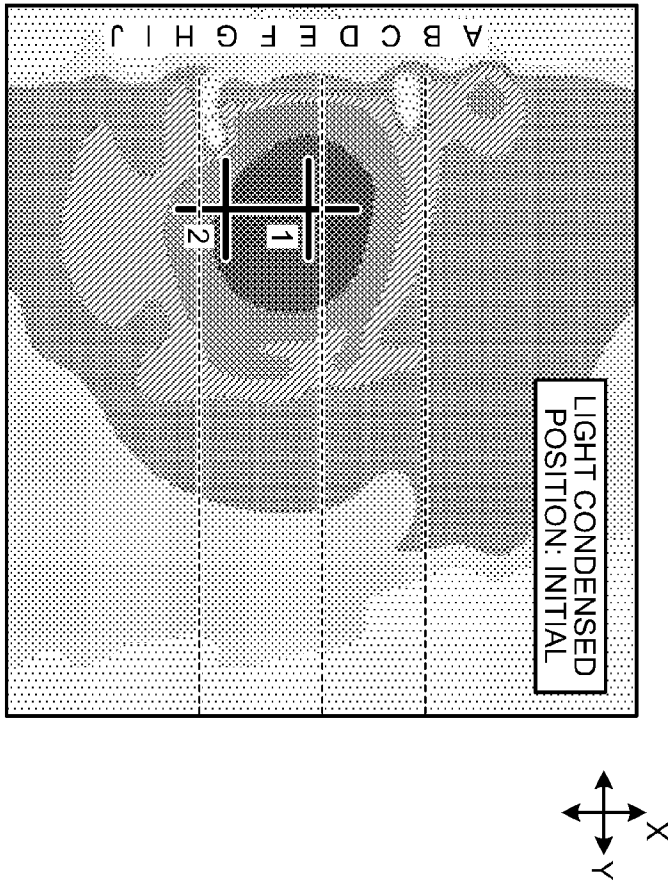
FIG. 4 is a diagram of a temperature distribution of the panel when a center of condensed light is located at one portion of the panel.
Figure 5:
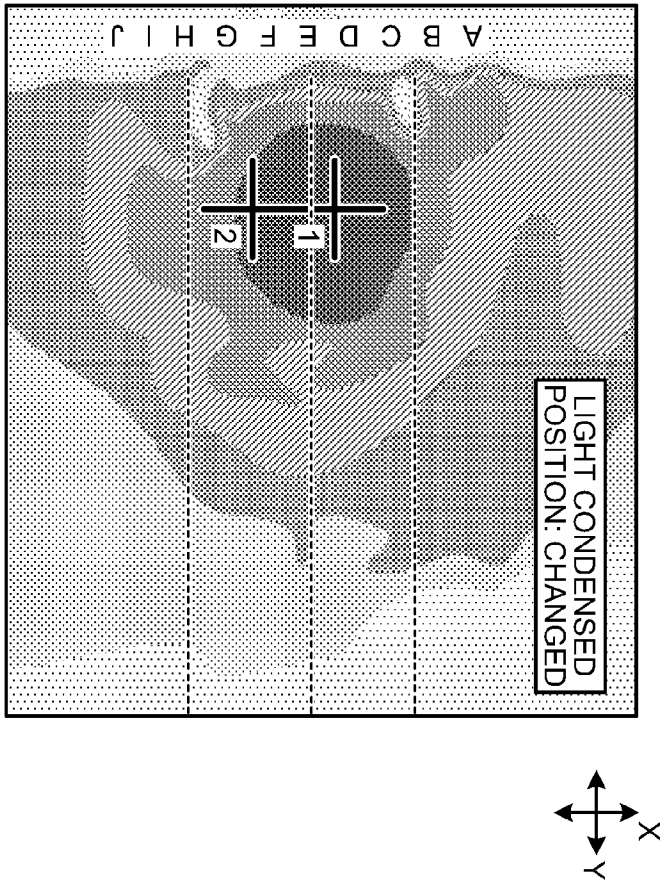
FIG. 5 is a diagram of a temperature distribution of the panel when a center of condensed light is located at one portion of the panel which is different from FIG. 4.
Figure 6:
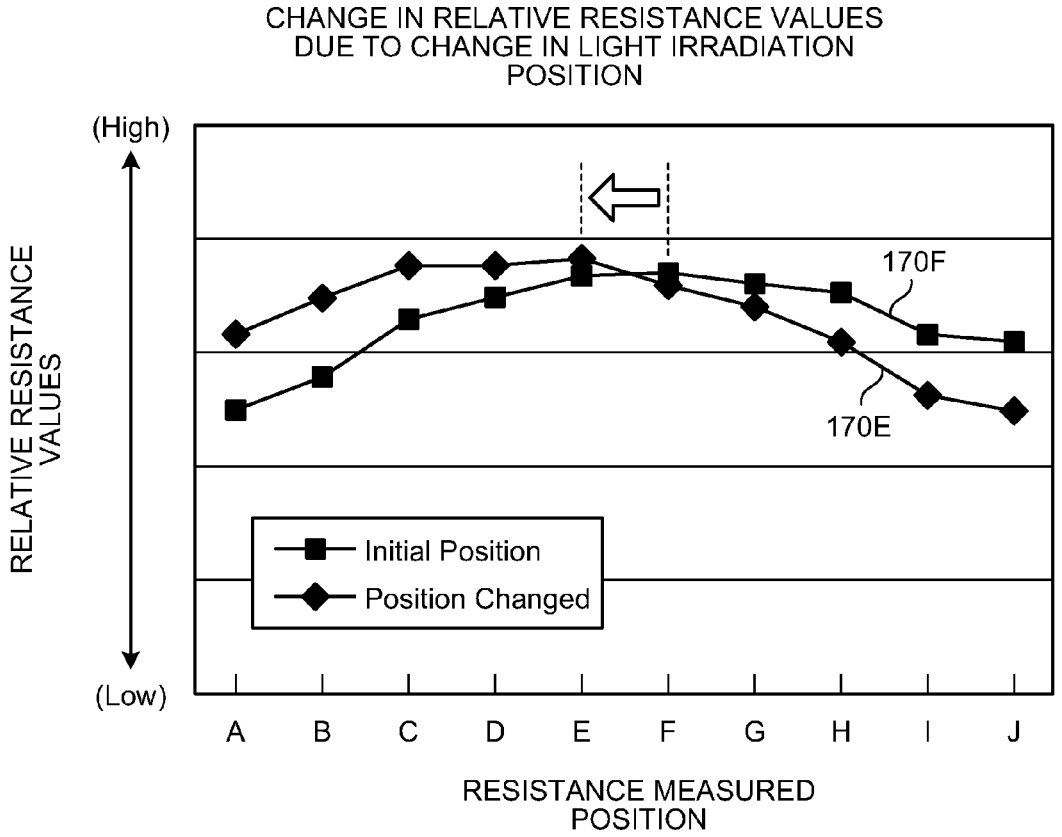
FIG. 6 is a diagram of an example of electrical resistance values of the electrodes in the temperature distributions illustrated in FIG. 4 and FIG. 5.

FIG. 3 is a diagram of an example of a configuration related to tests for measuring changes in electrical resistance values of the electrodes A to J when a temperature at a portion of the panel 161 is increased as compared with the temperatures at the other portions. FIG. 4 and FIG. 5 are diagrams of examples of a temperature distribution of the panel 161. FIG. 4 is a diagram of a temperature distribution when a center of condensed light is located at one portion of the panel 161. FIG. 5 is a diagram of a temperature distribution when a center of condensed light is located at one portion of the panel 161 which is different from FIG. 4. FIG. 6 is a diagram of an example of electrical resistance values of the electrodes A to J in the temperature distributions illustrated in FIG. 4 and FIG. 5.

As illustrated in FIG. 3, the panel 161 is irradiated with light from a light source 163 such as an artificial sunlight lamp to which light is condensed through a condenser lens 162. The position on the panel 161 where the condensed light is irradiated can be moved. A thermography 164 measures a temperature at each portion of the panel 161 and outputs images representing the temperature distributions of the panel 161, as illustrated in FIG. 4 and FIG. 5.

When the position to which the light condensed on the panel 161 is irradiated is moved from the electrode F to the electrode E during measuring the temperatures using the thermography 164, the higher temperature portions on the panel 161 move from the electrode F to the electrode E as illustrated in FIG. 4 and FIG. 5. The electrical resistance values of the electrodes A to J measured by the detecting unit 120 change, in association with the changes of the temperature distributions, from a resistance value distribution curve 170F to a resistance value distribution curve 170E as illustrated in FIG. 6. In other words, in association with the movement of the higher temperature portion in the temperature distribution of the panel 161 from the electrode F to the electrode E, a peak of the electrical resistance values also moves from the electrode F to the electrode E. In this way, the level of a temperature at each portion of the panel 161 and the level of the electrical resistance value indicated by each of the electrodes A to J provided at portions of the panel 161 are linked to each other. Therefore, by acquiring the electrical resistance values of the electrodes A to J provided in the panel 161, the information indicating the temperature distribution in the X direction of the panel 161 can be obtained.

Specifically, in the present embodiment, the specifying unit 135 specifies a temperature corresponding to each of the electrical resistance values of the electrodes A to J detected by the detecting unit 120 by using a correspondence between the electrical resistance value and the temperature indicated by the temperature model data 142. Thereby, the specifying unit 135 acquires information indicating a temperature at each position of the panel 161 in the X direction corresponding to each position of the electrodes A to J. Moreover, the specifying unit 135 can acquire the information indicating a temperature at each of the electrodes A to J as information indicating the temperature distribution in the X direction of the panel 161 in a range in which the electrodes A to J are provided.

In the present embodiment, the executing unit 136 outputs the identification information indicating an electrode at the highest temperature among the electrodes provided in the panel 161 and the command to notify the temperature of the electrode to the notifying unit 190. Specifically, when the position irradiated with the condensed light in the panel 161 is on the electrode F, the executing unit 136 outputs a command for causing the identification information notifying unit 191 to represent a sign "F" that indicates the position of the electrode F and for causing the temperature notifying unit 192 to represent the temperature of the electrode F to the notifying unit 190. After the position irradiated with the condensed light on the panel 161 moves from the electrode F to the electrode E and the temperature of the electrode E becomes higher than that of the electrode F, the executing unit 136 outputs a command for causing the identification information notifying unit 191 to represent a sign "E" that indicates the position of the electrode E and for causing the temperature notifying unit 192 to represent the temperature of the electrode E to the notifying unit 190. The implementation timing (for example, implementation period) at which the specifying unit 135 specifies the temperature and the executing unit 136 executes the command is performed arbitrarily. Here, the specifying unit 135 may make higher a specific frequency of the temperature related to a specific electrode (for example, an electrode at the position where the temperature tends to become high) as compared with the other electrodes. Specifically, by making higher the frequency at which the detecting unit 120 detects an electrical change related to the specific electrode (for example, an electrode at the position where the temperature tends to become high) as compared with the other electrodes, the specifying unit 135 may specify the temperature in response to the detection, or the specifying unit 135 may determine a specific frequency of the temperature to operate the detecting unit 120 according to the determined frequency. The executing unit 136 may execute the command to an electrode of the highest temperature or when the temperature of the electrode changes, or may execute the command of the content according to the result of the latest specification regardless of the change.

Figure 7:
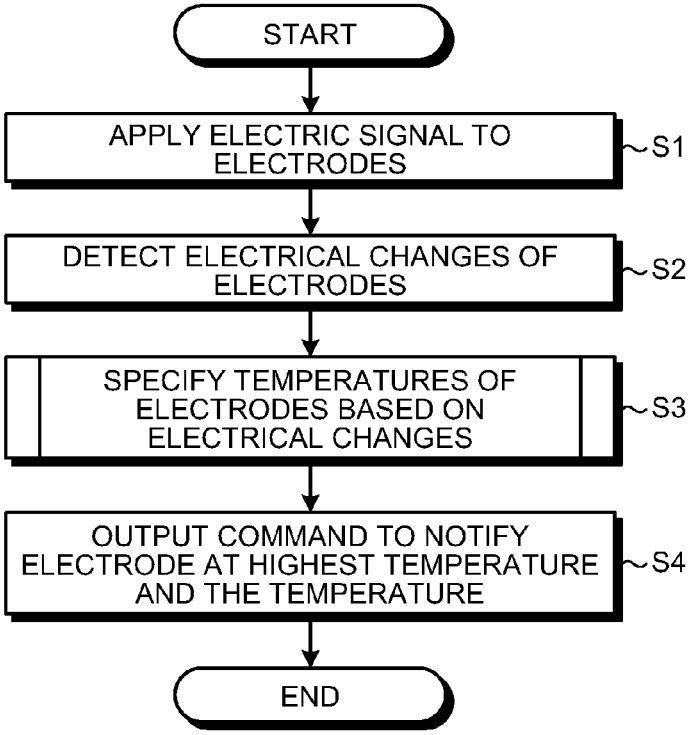
FIG. 7 is a flowchart of an example of an operation flow of each unit related to command execution.

FIG. 7 is a flowchart of an example of an operation flow of each unit related to command execution. The applying unit 110 applies an electric signal to the electrodes A to J (Step S1). The detecting unit 120 detects the electrical changes of the electrodes A to J occurring due to the electric signal applied at Step S1 (Step S2). In the first embodiment, an electrical resistance value of each of the electrodes A to J is measured at Step S2. The specifying unit 135 specifies a temperature at each of the electrodes A to J based on the electrical change detected at Step S2 (Step S3). The executing unit 136 executes the command based on the temperature information for each of the electrodes A to J specified at Step S3. For example, the executing unit 136 outputs the command to notify the identification information indicating an electrode of the highest temperature among the electrodes A to J and the temperature of the electrode to the notifying unit 190, and the notifying unit 190 performs notification according to the command at Step S4.

Figure 8:
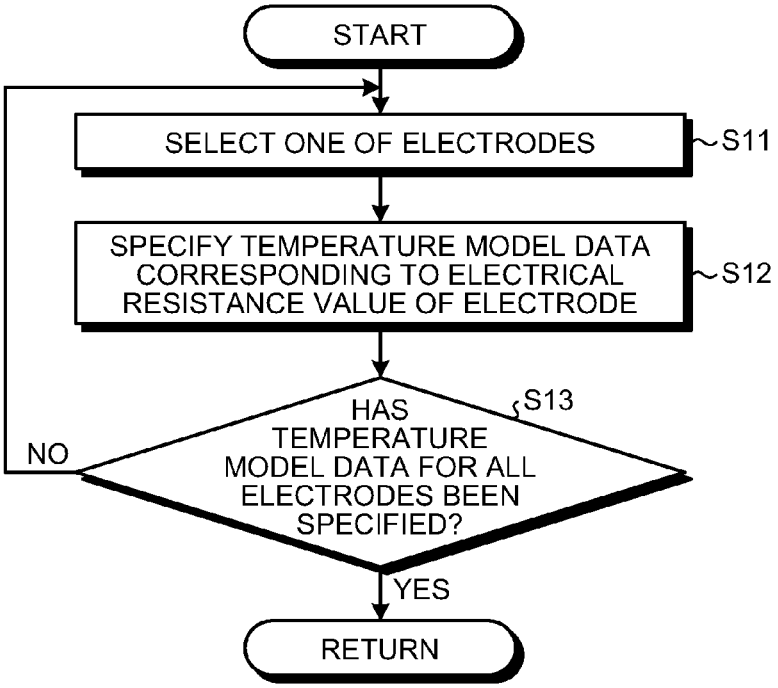
FIG. 8 is a sub-flowchart of an example of a specific processing content at Step S3 in the flowchart of FIG. 7.

FIG. 8 is a sub-flowchart of an example of a specific processing content at Step S3 in the flowchart of FIG. 7. The operation unit 132 selects one of electrodes (e.g., any one of the electrodes A, B, C, D, E, F, G, H, I, and J) in which information on the temperature is not specified (Step S11). The operation unit 132 specifies the temperature model data 142 corresponding to the electrical resistance value of the electrode selected at Step S11 (Step S12). By specifying the temperature model data 142, the temperature of the electrode indicated by the temperature model data 142 is specified. The operation unit 132 determines whether the temperature model data 142 for all the electrodes A to J have been specified (Step S13). When the temperature model data 142 for not all the electrodes A to J have been specified (No at Step S13), the processing shifts to Step S11. When the temperature model data 142 for all the electrodes A to J have been specified (Yes at Step S13), the operation unit 132 completes the processing of Step S3. The embodiment is not limited to the method of looping the processing related to specification of the temperature of one electrode by the number of electrodes. It may therefore be configured to specify a temperature of part or all of the electrodes through parallel processing.

As explained above, according to the first embodiment, each temperature of the electrodes A to J can be specified based on the detection result of the electrical change according to the temperature. Thus, the temperature of the surface of the panel 161 where the electrodes A to J are provided can be detected.

Moreover, the respective temperatures of the electrodes A to J can be separately specified. Therefore, the temperatures at portions of the panel 161 in the X direction, in which the electrodes A to J are provided in parallel, can be individually detected.

2. Second Embodiment

Figure 9:
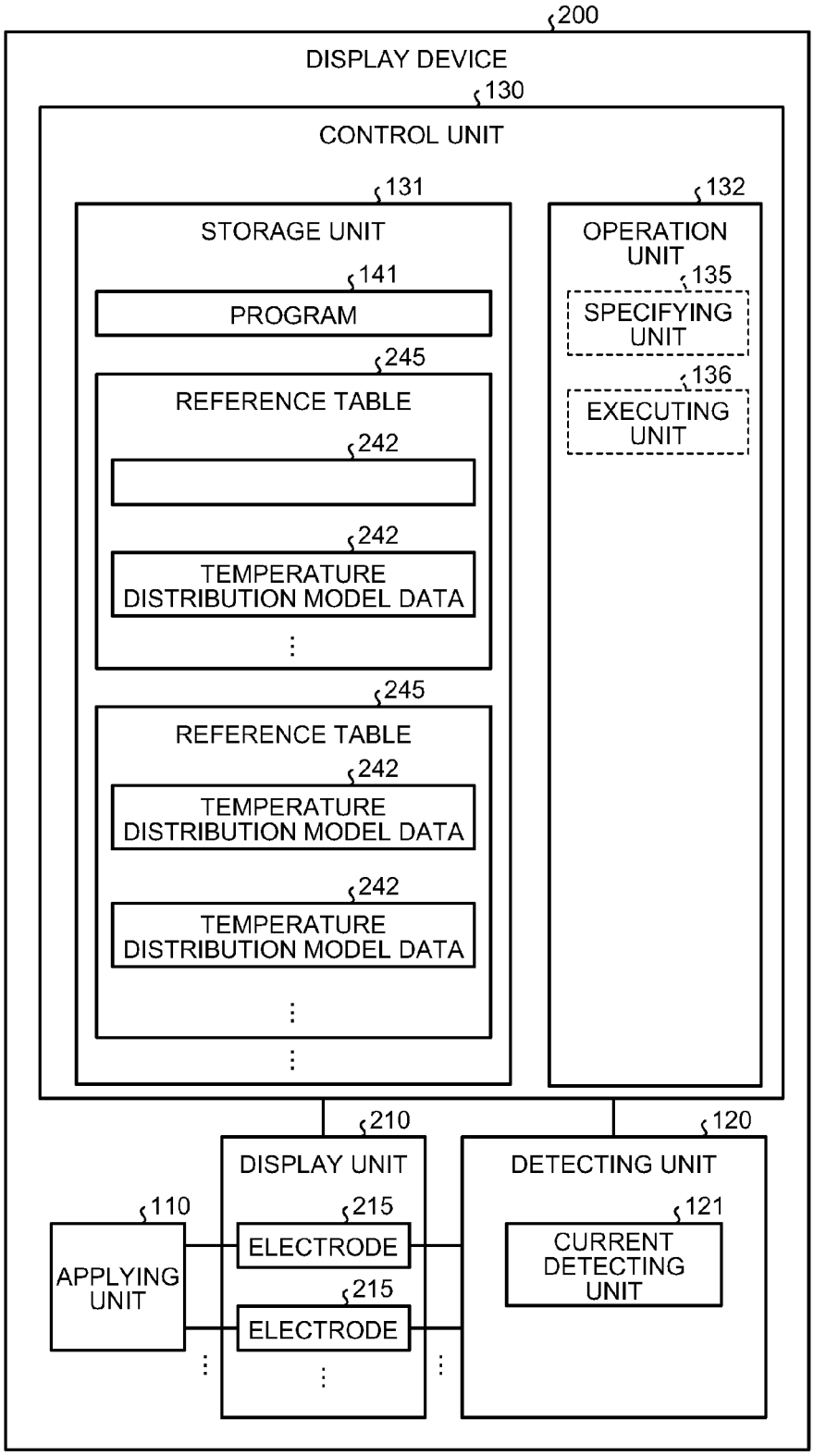
FIG. 9 is a block diagram of a configuration related to main functions of a display device according to a second embodiment.

A second embodiment of the present invention will be explained next with reference to FIG. 9 to FIG. 18. The second embodiment is an embodiment of the display device (display device 200) according to the present invention. In the second embodiment, the same reference signs are assigned to the same components as these of the first embodiment, and explanation thereof may be omitted. FIG. 9 is a block diagram of a configuration related to main functions of the display device 200 according to the second embodiment. The display device 200 includes a display unit 210. The display unit 210 is, for example, a liquid crystal display. The display device 200 includes electrodes 215 instead of the electrodes A to J in the first embodiment. The electrodes 215 are provided in the display unit 210.

The detecting unit 120 according to the second embodiment includes a current detecting unit 121 that detects the current values flowing through the electrodes 215. The detecting unit 120 causes the current detecting unit 121 to detect the change in the current value occurring due to the electric signal applied by the applying unit 110. The detecting unit 120 outputs the signal indicating the detected electrical change (change in the current value) to the control unit 130.

The storage unit 131 according to the second embodiment stores a plurality of pieces of temperature distribution model data 242. The temperature distribution model data 242 is data indicating a relationship between a detection result of the current value flowing through the electrode 215 detected by the detecting unit 120 and the temperature distribution of the electrode 215. In the second embodiment, among the pieces of temperature distribution model data 242, pieces of temperature distribution model data 242 whose equilibrium current values (explained later) are the same as each other are combined into one reference unit (for example, a reference table 245). The specifying unit 135 according to the second embodiment specifies, from the information indicating a change in the current value detected by the detecting unit 120, the temperature distribution model data 242 corresponding to the change. The "temperature distribution" represents not only the levels of relative temperatures at portions of the electrode 215 but also specific degrees (for example, degrees centigrade) of the temperatures at portions. In other words, by using the temperature distribution model data 242, specific temperatures at portions of the electrode 215 can be calculated.

The executing unit 136 according to the second embodiment executes the command to control the operation of the display unit 210 based on the temperature information for the electrodes 215. Specifically, for example, when part or all of the electrodes 215 exceed a first temperature (e.g., 100° C.), the executing unit 136 outputs a command for causing the display unit 210 to terminate the display to the display unit 210. The display unit 210 terminates the display operation according to the command. This enables to prevent continuation of the display while the display remains disturbed due to an increase in the temperature on the display surface of the display unit 210.

Figure 10:
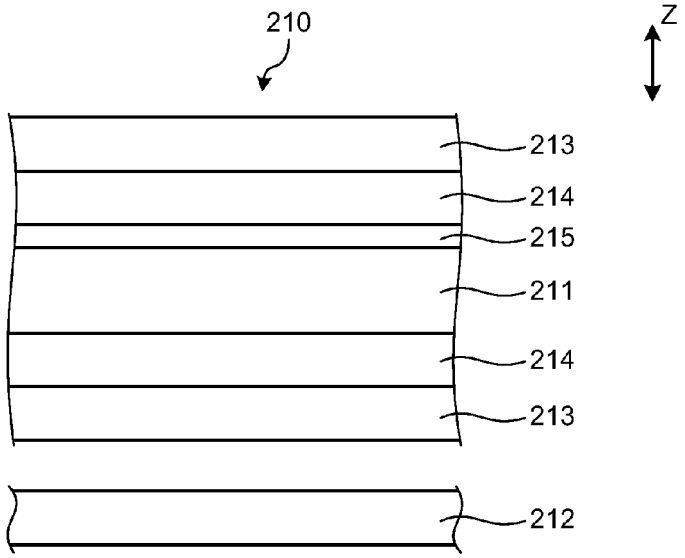
FIG. 10 is a diagram of an example of an arrangement of temperature sensor electrodes incorporated in a display unit of the display device according to the present invention.

The display unit 210 and the electrode 215 will be explained in detail below. FIG. 10 is a diagram of an example of an arrangement of temperature sensor electrodes (hereinafter, described as electrodes 215) incorporated in the display unit 210 of the display device 200. As illustrated in FIG. 10, the display unit 210 includes a liquid crystal cell 211, a light source 212, and two polarizers 213. The electrodes 215 are provided, for example, between the polarizer 213 on the display surface side and the liquid crystal cell 211.

Figure 11:
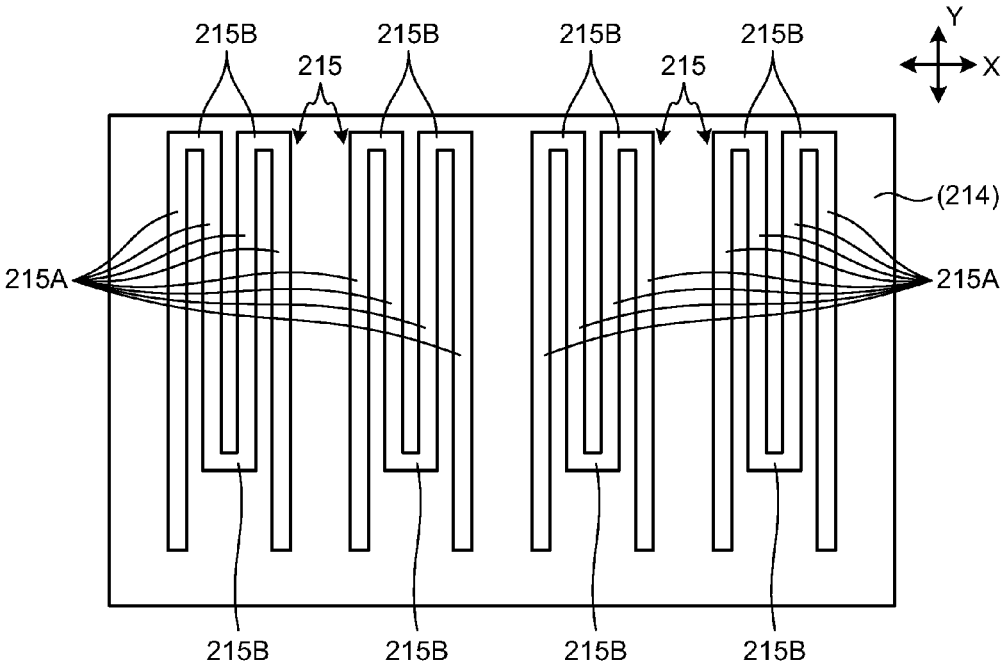
FIG. 11 is a diagram of an example of a specific shape and arrangement of the electrodes.
Figure 12:
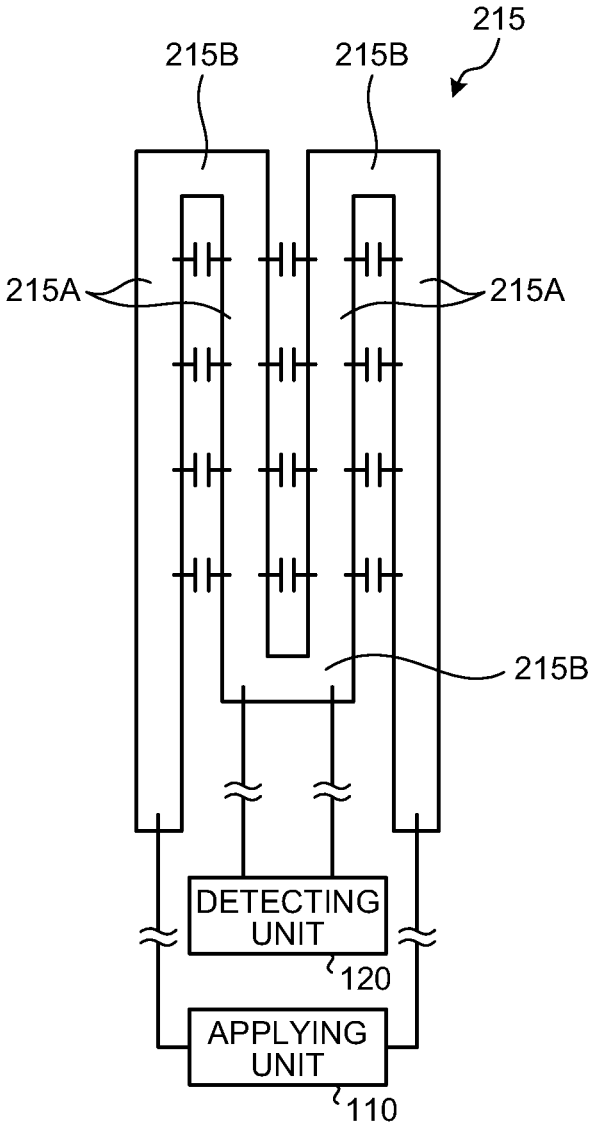
FIG. 12 is a diagram of electrical characteristics related to one of the electrodes.

FIG. 11 is a diagram of an example of a specific shape and arrangement of the electrodes 215. FIG. 12 is a diagram of electrical characteristics related to one of the electrodes 215. As illustrated in FIG. 11, the electrode 215 includes a plurality of extension portions 215A provided in parallel at an interval in the X direction along the display surface of the display unit 210, and a coupling portion 215B that couples one ends of the extension portions 215A. The longitudinal direction of each of the extension portions 215A is along the Y direction. Specifically, the electrode 215 has, for example, four extension portions 215A each of which longitudinal direction is along the Y direction. Among the four extension portions 215A, the ends of adjacent two extension portions 215A in the X direction and the coupling portion 215B are coupled to each other so as to form a shape which is bent in U-shape. The four extension portions 215A and three coupling portions 215B are provided as a continuous single conductive wire. In other words, as illustrated in FIG. 11 and FIG. 12, the electrode 215 has a shape of, for example, substantially a character "M", in which the bent portions in the character "M" are formed as a combination of bent portions with two right angles which are bent in the same direction and are folded by 180°. In other words, the electrode 215 is a single conductive line which is bent so as to become a shape obtained by removing a bottom side from a U-shaped frame.

The electrode 215 is a transparent electrode. Specifically, the electrode 215 is a thin film transparent electrode made of, for example, indium tin oxide (ITO).

As illustrated in FIG. 12, the applying unit 110 according to the second embodiment is coupled to, for example, both ends of the electrode 215. The detecting unit 120 according to the second embodiment is coupled to, for example, both sides of the coupling portion 215B at a center portion of the electrode 215 in the X direction. Specifically, wirings are provided between the electrode 215 and the applying unit 110 and between the electrode 215 and the detecting unit 120, both of which are provided outside the electrode 215. The electrode 215, the applying unit 110, and the detecting unit 120 are electrically coupled to each other through the wirings.

The interval between the two extension portions 215A in the X direction is an interval at which an electric charge is stored between the two extension portions 215A. In other words, as illustrated in FIG. 12, of the electrode 215, a portion adjacent to the extension portions 215A functions as a capacitor and has an electrostatic capacitance (hereinafter, "capacitance") by storing an electric charge. The capacitance of the extension portion 215A as the capacitor changes according to a voltage between the extension portions 215A. Therefore, the electrical resistance value of the extension portion 215A changes, which results in the change in the capacitance.

As illustrated in FIG. 11, the electrode 215 is provided in plural along the X direction. The interval between the electrodes 215 in the X direction is an interval at which an electric charge is not stored between electrodes 215. The "interval at which an electric charge is not stored between electrodes 215" mentioned here indicates an interval at which the electrodes 215 do not function as a capacitor in cooperation with each other. Additionally, even if the electrodes 215 function as a capacitor in cooperation with each other, the interval indicates an interval at which the capacitance is small to such an extent that it can be substantially negligible when the electrical change is detected by the detecting unit 120. This enables the respective electrodes 215 to be made electrically independent from each other. Therefore, the electrical change in each of the electrodes 215 can be more appropriately detected.

The electrodes 215 illustrated in FIG. 11 are bonded to the polarizer 213 by an adhesive layer 214. The adhesive layer 214 may include a substance (e.g., resin) functioning as a dielectric. In other words, the dielectric may be interposed between the extension portions 215A. In this case, an interval between two extension portions 215A included in one electrode 215 in the X direction and an interval between electrodes 215 in the X direction are determined in consideration of the influence of the dielectric on the capacitance. Specifically, for example, the full width of one electrode 215 in the X direction with the shape obtained by removing the bottom side from the U-shaped frame is 2 mm to 3 mm, preferably 2 mm. The interval between the electrodes 215 in the X direction is equal to or wider than 1.5 mm. The number and the arrangement of the electrodes 215 illustrated in FIG. 11 are merely schematic. The number and the arrangement of the electrodes 215 according to the present invention are arbitrary. For example, the electrodes 215 may be arranged only in a portion (for example, a center area of a head-up display (HUD) in the X direction where the temperature tends to increase) of the display unit 210 where the temperature tends to increase. Moreover, it may be configured that a larger number of electrodes 215 are intensively and highly densely arranged in the portion while totally arranging electrodes 215 in the X direction.

Figure 13:
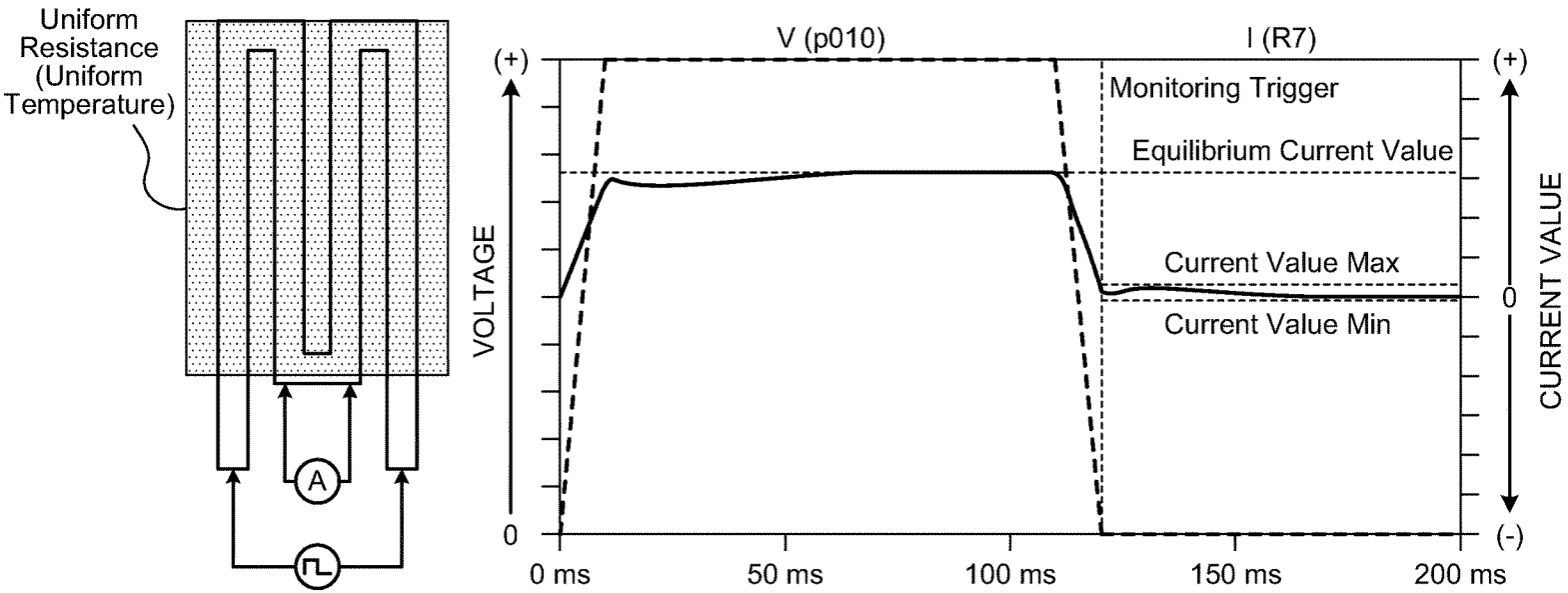
FIG. 13 is a diagram of an example of a change in a current value when the temperatures on the entire electrode are uniform.
Figure 14:
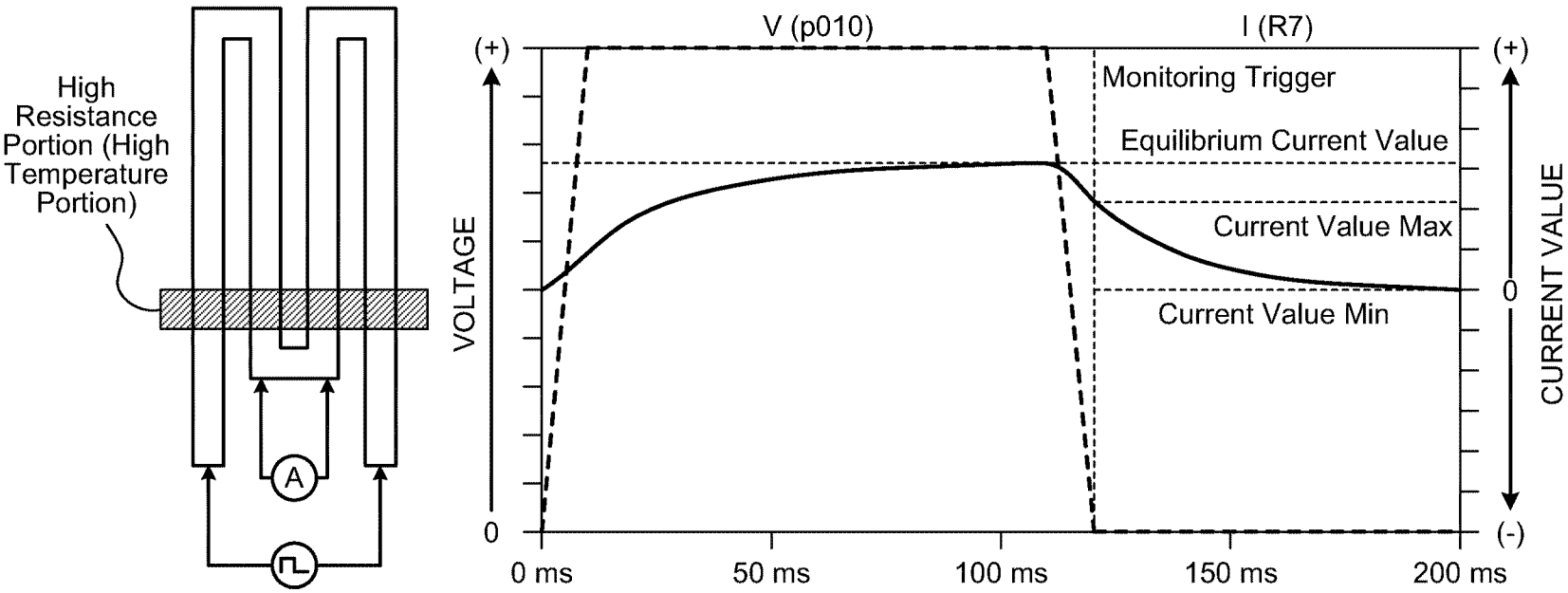
FIG. 14 is a diagram of an example of a change in the current value when the temperature at a portion on the end side, of the entire electrode, coupled to the detecting unit (lower side of the electrode illustrated in FIG. 11 and FIG. 12) is high as compared with the temperatures at the other portions.
Figure 15:
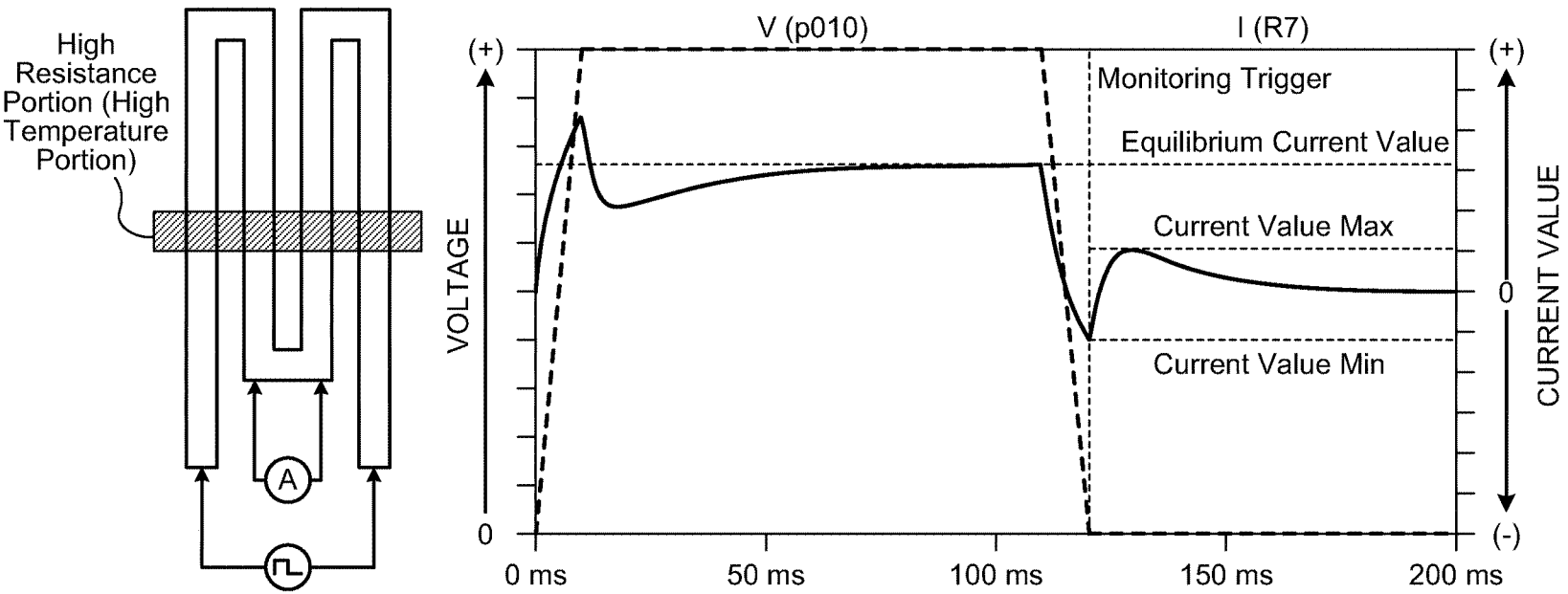
FIG. 15 is a diagram of an example of a change in the current value when the temperature at a center portion of the electrode in a Y direction is high as compared with the temperatures at the other portions.
Figure 16:
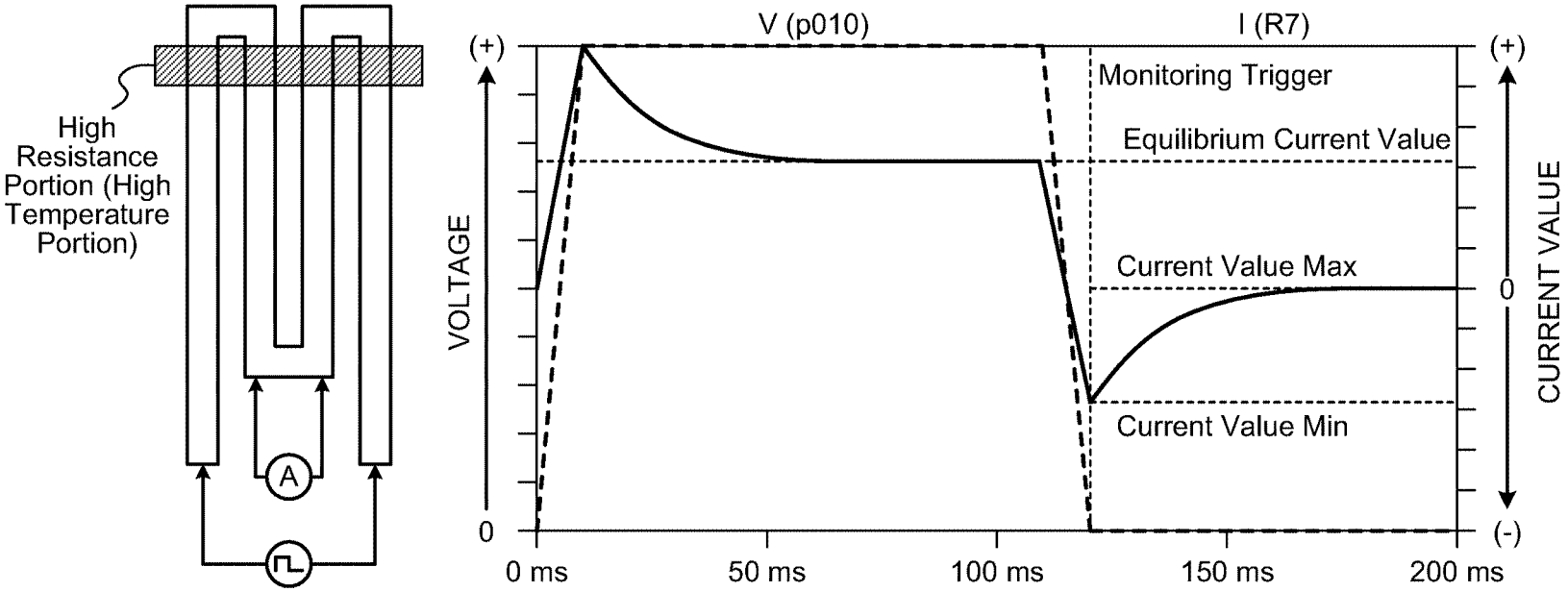
FIG. 16 is a diagram of an example of a change in the current value when the temperature at a portion on an opposite side of the end of the electrode (upper side of the electrode illustrated in FIG. 11 and FIG. 12) is high as compared with the temperatures at the other portions.

A relationship between a detection result of current values and a temperature distribution of the electrode 215 will be explained in detail next. FIG. 13 to FIG. 16 are diagrams of examples of a correspondence between a change in a current value detected by the detecting unit 120 and a temperature distribution of the electrode 215. FIG. 13 is a diagram of an example of a change in the current value when the temperatures on the entire of the electrode 215 are uniform. FIG. 14 is a diagram of an example of a change in the current value when the temperature at a portion on the end side, of the electrode 215, coupled to the detecting unit 120 (lower side of the electrode 215 illustrated in FIG. 11 and FIG. 12) is high as compared with the temperatures at the other portions. FIG. 15 is a diagram of an example of a change in the current value when the temperature at a center portion of the electrode 215 in the Y direction is high as compared with the temperatures at the other portions. FIG. 16 is a diagram of an example of a change in the current value when the temperature at a portion on an opposite side of the end of the electrode 215 (upper side of the electrode 215 illustrated in FIG. 11 and FIG. 12) is high as compared with the temperatures at the other portions. The character "E" included in description of "fEA" in the following explanation is a character "E" with a circumflex, but the circumflex is omitted in the description of the specification. The "Uniform" in the second embodiment indicates that the temperatures at portions set at a plurality of different locations (for example, three locations illustrated in FIG. 14 to FIG. 16) in the Y direction of the electrode 215 are substantially the same in a temperature resolution based on a correspondence with the current values (electrical resistance values), or that a temperature difference between the portions is within a predetermined range (e.g., within 1° C.)

The applying unit 110 outputs a pulse signal to the electrode 215, the pulse signal in which a pulse rises during a first predetermined time (for example, 110 milliseconds (ms) to 120 milliseconds (ms)) and thereafter the pulse falls during a second predetermined time (for example, 80 ms to 90 ms). Descriptions may be as follows: the rising of the pulse is described as "pulse-on", the rise time of the pulse as "pulse-on time", the falling of the pulse as "pulse-off", the timing of occurrence of the pulse-off as "pulse-off time", and the time after the pulse-off time as "after the pulse-off". Specifically, "after the pulse-off" is the time, for example, after 120 ms in FIG. 13 to FIG. 16.

As illustrated in FIG. 13, when the temperatures on the entire electrode 215 are uniform, a difference between a maximum current value (current value Max) after the pulse-off and a minimum current value (current value Min) after the pulse-off is smaller than 50 [fEA]. On the other hand, as illustrated in FIG. 14 to FIG. 16, when the temperature at a portion of the electrode 215 is high as compared with the temperatures at the other portions, a difference between the current value Max after the pulse-off and the current value Min after the pulse-off is larger than 100 [fEA]. In this way, there is a correlation between the uniformity of the temperatures of the electrode 215 and the difference between the current value Max and the current value Min after the pulse-off. If the temperatures on the entire electrode 215 are closer to the uniformity, the difference between the current value Max and the current value Min after the pulse-off is decreased.

As illustrated in FIG. 14 to FIG. 16, when a position of a portion at high temperature as compared with the temperatures at the other portions of the electrode 215 is different, the value of the current value Max and the value of the current value Min after the pulse-off become different values. In this way, there are correlations between the position of a portion at high temperature as compared with the temperatures at the other portions of the electrode 215 and the value of the current value Max after the pulse-off and between the position thereof and the current value Min after the pulse-off.

The changes in the value of the current value Max and the value of the current value Min after the pulse-off are based on a correspondence between the temperature of a material forming the electrode 215 and the electrical resistance value. The metal forming the electrode 215 increases in proportion to an increase in the temperature. Therefore, the equilibrium current value lowers in proportion to the increase in the temperature. Moreover, the capacitance increases in the portion, of the electrode 215, where the temperature increases. Therefore, the higher the temperature of the electrode 215 is, the difference between the current value Max and the current value Min after the pulse-off becomes larger in association with the increase of the capacitance discharged from the electrode 215 at the pulse-off time.

When the temperature at a portion of the electrode 215 is higher as compared with the temperatures at the other portions, this portion has a higher resistance. Thereby the capacitance in this portion becomes larger, and the discharge amount increases. Moreover, the portion works so as to prevent the discharge from the capacitances of the other portions at low temperature. Therefore, a discharge pattern changes according to a position of the portion at high temperature. The detecting unit 120 detects the change of the discharge pattern. From the configuration, the temperature distribution model data 242 can be specified based on the level of the equilibrium current value, the difference between the current value Max and the current value Min after the pulse-off, and the value of the current value Max and the value of the current value Min after the pulse-off.

Specifically, the temperature distribution model data 242 according to the second embodiment is data indicating the equilibrium current value, a combination pattern of the value of the current value Max and the value of the current value Min after the pulse-off (as well as the difference between the value of the current value Max and the value of the current value Min), and the temperature distribution of the electrode when the combination pattern is established. Therefore, it is possible to specify the temperature distribution of the electrode 215 by detecting an electrical change (the equilibrium current value indicated by the change in the current value, and the value of the current value Max and the value of the current value Min after the pulse-off) according to the temperature at each of portions of the electrode 215 and by specifying the temperature distribution model data 242 corresponding to the detected electrical change.

The equilibrium current values illustrated in FIG. 13 to FIG. 16 are the same as each other. Therefore, the operation unit 132 that functions as the specifying unit 135 can narrow down the temperature distribution model data 242 stored in the storage unit 131 based on the equilibrium current values at the pulse-on time. The operation unit 132 specifies the temperature distribution model data 242 corresponding to the change in the current value based on the current value Max and the current value Min after the pulse-off from the narrowed down temperature distribution model data 242. Therefore, for example, the storage unit 131 may store the temperature distribution model data 242 in a data format in which a plurality of pieces of temperature distribution model data 242 whose equilibrium current values are the same as each other are combined into one reference unit (for example, the reference table 245). In other words, the reference table 245 is aggregate data obtained by grouping the temperature distribution model data 242 corresponding to the detection result indicating the same equilibrium current values, and therefore part of the pieces of temperature distribution model data 242 can be narrowed down using the equilibrium current value. This enables the operation unit 132 to specify the reference table 245 based on the equilibrium current value and to specify the temperature distribution model data 242 corresponding to the change pattern of the current value among the temperature distribution model data 242 included in the reference table 245 based on the current value Max and the current value Min after the pulse-off. In this way, the specifying unit 135 can specify the temperature distribution in the Y direction of the electrode 215 based on the equilibrium current value of the electrode 215 applied with the electric signal and based on the change in the current value occurring after the state is changed from the electric-signal applied state to its non-applied state.

More specifically, for example, an electrical resistance value of a portion on the end side, of the electrode 215, coupled to the detecting unit 120 is set as Ω1. An electrical resistance value of a center portion of the electrode 215 in the Y direction is set as Ω2. An electrical resistance value of a portion on the opposite side to the end side of the electrode 215 is set as Ω3. An electrical resistance value of the electrode 215 when the temperatures at these portions are a certain uniform temperature (temperature C1) is set as ΩA. In this case, it is assumed that Ω1+Ω2+Ω3=ΩA holds and that an equilibrium current value A1 is detected by the detecting unit 120 at the pulse-on time. Here, there is a case where the temperature at any portion (e.g., center portion) is higher than the temperature C1 and this causes the electrical resistance value at this portion to increase, and there is a case where the temperatures at the other portions is lower than the temperature C1 and this causes the electrical resistance values of the other portions to decrease. Then a relation of Ω2>Ω1 (or Ω3) holds between these cases. On the other hand, when the relation holds, the electrical resistance values of the entire electrode 215 may result in Ω1+Ω2+Ω3=ΩA. Even in this case, the equilibrium current value A1 is detected by the detecting unit 120 at the pulse-on time. In other words, even if the equilibrium current values detected by the detecting unit 120 at the pulse-on time are the same as each other, there can be cases where the temperatures at the portions are "Uniform" and where the temperature at one portion is high as compared with the other portions. In these cases, the current values after the pulse-off change differently. Therefore, the temperature distribution of the electrode 215 can be specified based on the change in the current value after the pulse-off.

The correspondence between the change in the current value and the temperature distribution of the electrode 215 illustrated in FIG. 13 to FIG. 16 is merely an example. The storage unit 131 stores the pieces of temperature distribution model data 242 each indicating a correspondence between a plurality of patterns of the temperature distribution of the electrode 215 and change patterns of the current value according to each of the patterns.

The specifying unit 135 according to the second embodiment individually specifies the temperature distributions of electrodes 215 provided in parallel in the X direction. Thus, the display device 200 according to the second embodiment can specify each temperature of the electrodes 215 provided in parallel in the X direction similarly to the temperature information acquiring device 100 according to the first embodiment.

Various resolutions related to acquisition of temperature information using the electrode 215 respond to specific aspects according to the embodiments of the present invention. For example, when the width of one electrode 215 in the X direction is 2 mm and an interval between electrodes 215 is 1.5 mm, the specifying unit 135 can specify the temperature at each portion of the surface (for example, the display surface of the liquid crystal display) in units of a range with a radius of about 1 cm. The resolution in the X direction can be changed by changing the interval between the electrodes 215. The resolution in the Y direction responds to the number of patterns of data (for example, temperature distribution data) referred to for specifying the temperature of the electrode 215. For the temperature at a portion that cannot be specified directly only by referring to the data, the specifying unit 135 may specify the temperature of the electrode 215 by performing interpolation processing using, for example, a plurality of data similar to the detection result detected by the detecting unit 120, or may adopt most similar data by referring to all the data. The data is based on consideration of the wiring for coupling the electrode 215, the applying unit 110, and the detecting unit 120.

When the equilibrium current value detected by the detecting unit 120 is relatively large, the temperature of the electrode 215 is relatively low. Therefore, when the equilibrium current value is a certain threshold (a first threshold) or higher i.e. the electrical resistance value of the entire electrode 215 is the electrical resistance value corresponding to the threshold or lower, a portion that exceeds the first temperature may not exist in the electrode 215 even if it may be any kind of the temperature distribution. In this case, the executing unit 136 does not execute the command, and therefore detailed specification of the temperature distribution is not needed in terms of the operation control performed by the executing unit 136. For this reason, in the second embodiment, when the equilibrium current value is the first threshold or higher, the specification of the temperature distribution of the electrode 215 performed by the specifying unit 135 is omitted.

Figure 17:
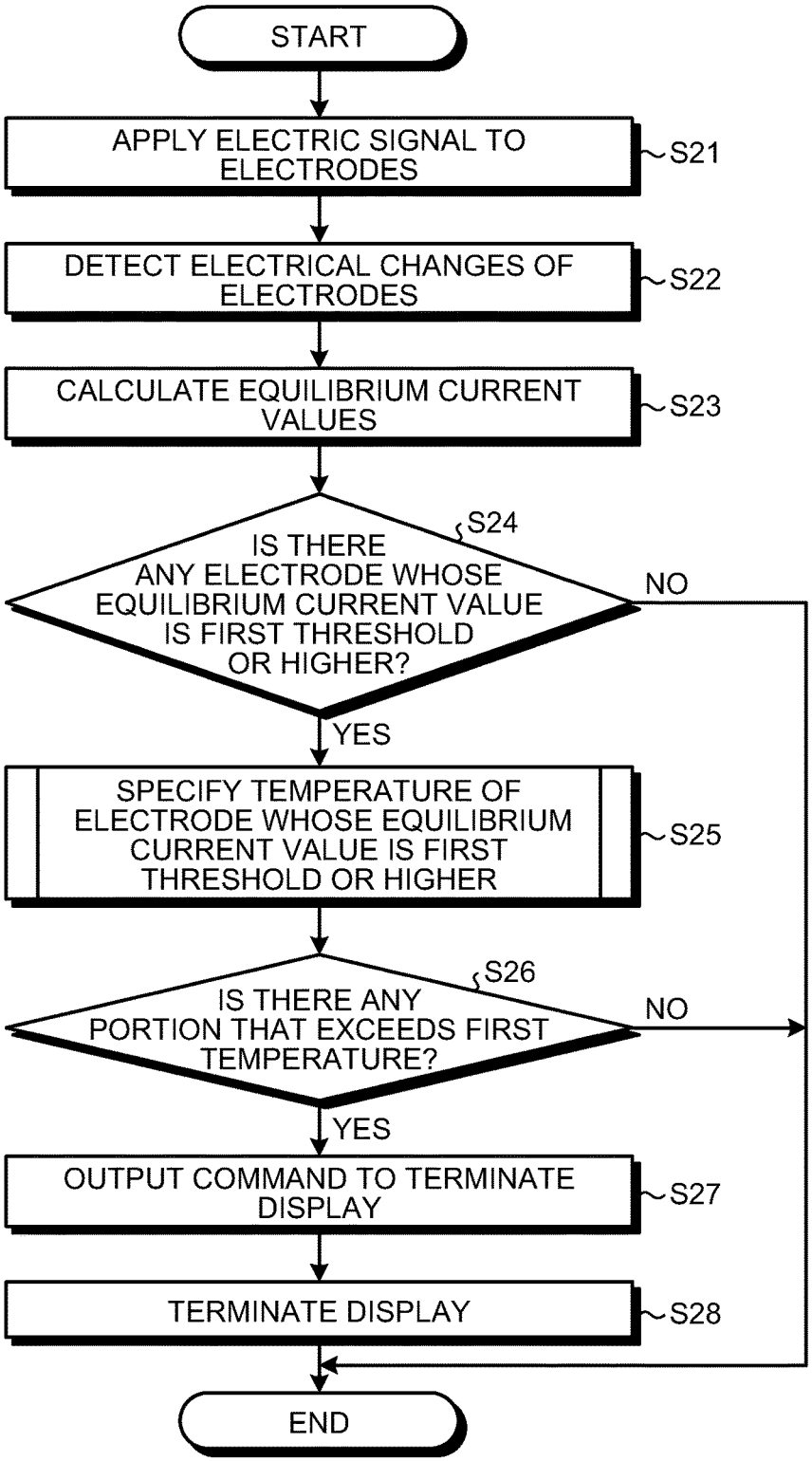
FIG. 17 is a flowchart of an example of a processing flow related to temperature information for an electrode 215 according to the second embodiment.

FIG. 17 is a flowchart of an example of a processing flow related to temperature information for the electrode 215 according to the second embodiment. The applying unit 110 applies an electric signal to the electrodes 215 (Step S21). The detecting unit 120 detects the electrical changes of the electrodes 215 occurring due to the electric signal applied at Step S21 (Step S22). In the second embodiment, the changes of the current values in the electrodes 215 are measured at Step S22. The specifying unit 135 calculates the equilibrium current values (Step S23). The specifying unit 135 determines whether an equilibrium current value being the first threshold or higher is included in the equilibrium current values calculated at Step S23 (Step S24). When it is determined that all the equilibrium current values are less than the first threshold (No at Step S24), the processing related to the temperature information for the electrode 215 is terminated. When it is determined that the equilibrium current value being the first threshold or higher is included (Yes at Step S24), the specifying unit 135 specifies the temperature distribution of the electrode 215 whose equilibrium current value is the first threshold or higher (Step S25). The executing unit 136 determines whether there is a portion that exceeds the first temperature in the temperature distribution of the electrode 215 specified at Step S25 (Step S26). When it is determined that there is a portion that exceeds the first temperature (Yes at Step S26), the executing unit 136 outputs the command for causing the display unit 210 to terminate the display to the display unit 210 (Step S27). The display unit 210 terminates the display operation according to the command at Step S27 (Step S28). After the processing of Step S28 or when it is determined that there is no portion that exceeds the first threshold at Step S26 (No at Step S26), the processing related to the temperature information for the electrode 215 is terminated. The way to specify the temperature distribution of the electrode 215 whose equilibrium current value is the first threshold or higher is merely an example, and the embodiment is not therefore limited thereto and can be modified as necessary. For example, the temperature distributions of all the electrodes 215 may be calculated regardless of the equilibrium current values.

Figure 18:
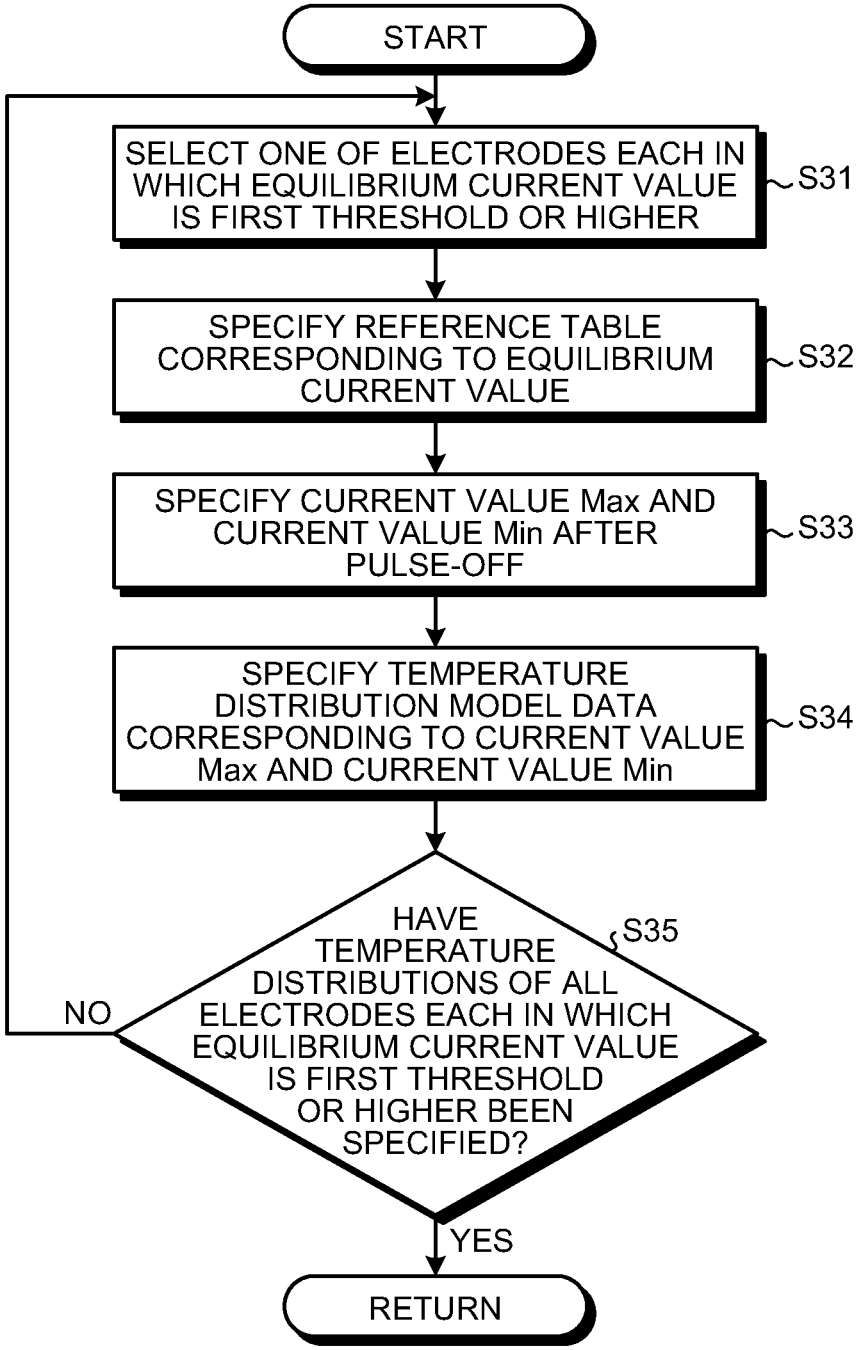
FIG. 18 is a flowchart of an example of a specific processing flow of temperature distribution model data performed by a specifying unit according to the second embodiment.

FIG. 18 is a flowchart of an example of a specific processing flow of the temperature distribution model data 242 performed by the specifying unit 135 in the second embodiment. The flowchart illustrated in FIG. 18 is a sub-flowchart of Step S25 in the flowchart illustrated in FIG. 17. The operation unit 132 selects one electrode 215, in which information related to the temperature is not specified, among the electrodes 215 each in which the equilibrium current value is the first threshold or higher (Step S31). The operation unit 132 specifies the reference table 245 corresponding to the equilibrium current value of the electrode 215 selected at Step S31 (Step S32). The operation unit 132 calculates the value of the current value Max and the value of the current value Min after the pulse-off (Step S33). The operation unit 132 specifies the temperature distribution model data 242 corresponding to the value of the current value Max and to the value of the current value Min calculated at Step S33, among the temperature distribution model data 242 included in the reference table 245 specified at Step S32 (Step S34). By specifying the temperature distribution model data 242, the temperature distribution of the electrode 215 indicated by the temperature distribution model data 242 is specified. The operation unit 132 determines whether the temperature distributions of all the electrodes 215 each in which the equilibrium current value is the first threshold or higher have been specified (Step S35). When the temperature distributions of not all the electrodes 215 have been specified (No at Step S35), the processing shifts to Step S31. When the temperature distributions of all the electrodes 215 have been specified (Yes at Step S35), the operation unit 132 terminates the specification processing of the temperature distribution model data 242.

As explained above, according to the second embodiment, the temperature distribution in the Y direction of each of the electrodes 215 can be specified in addition to the effects of the first embodiment. Similarly to the first embodiment, the temperature of each of the electrodes 215 in the X direction can be individually detected. From the configuration, the temperatures at portions on the display surface of the display unit 210 where the electrodes 215 are provided can be specified.

When part or all of the electrodes 215 exceeds a predetermined temperature (e.g. 100° C.), the command causes the display unit 210 to terminate the display, and therefore occurrence of the problem such as disturbance in display caused by the increase in the temperature on the display surface of the display unit 210 can be prevented.

Moreover, because the electrode 215 is transparent, the influence due to the electrode 215, which is provided on the display surface of the display unit 210 in order to acquire the temperature information, on the display content can be further reduced.

3. Third Embodiment

Figure 19:
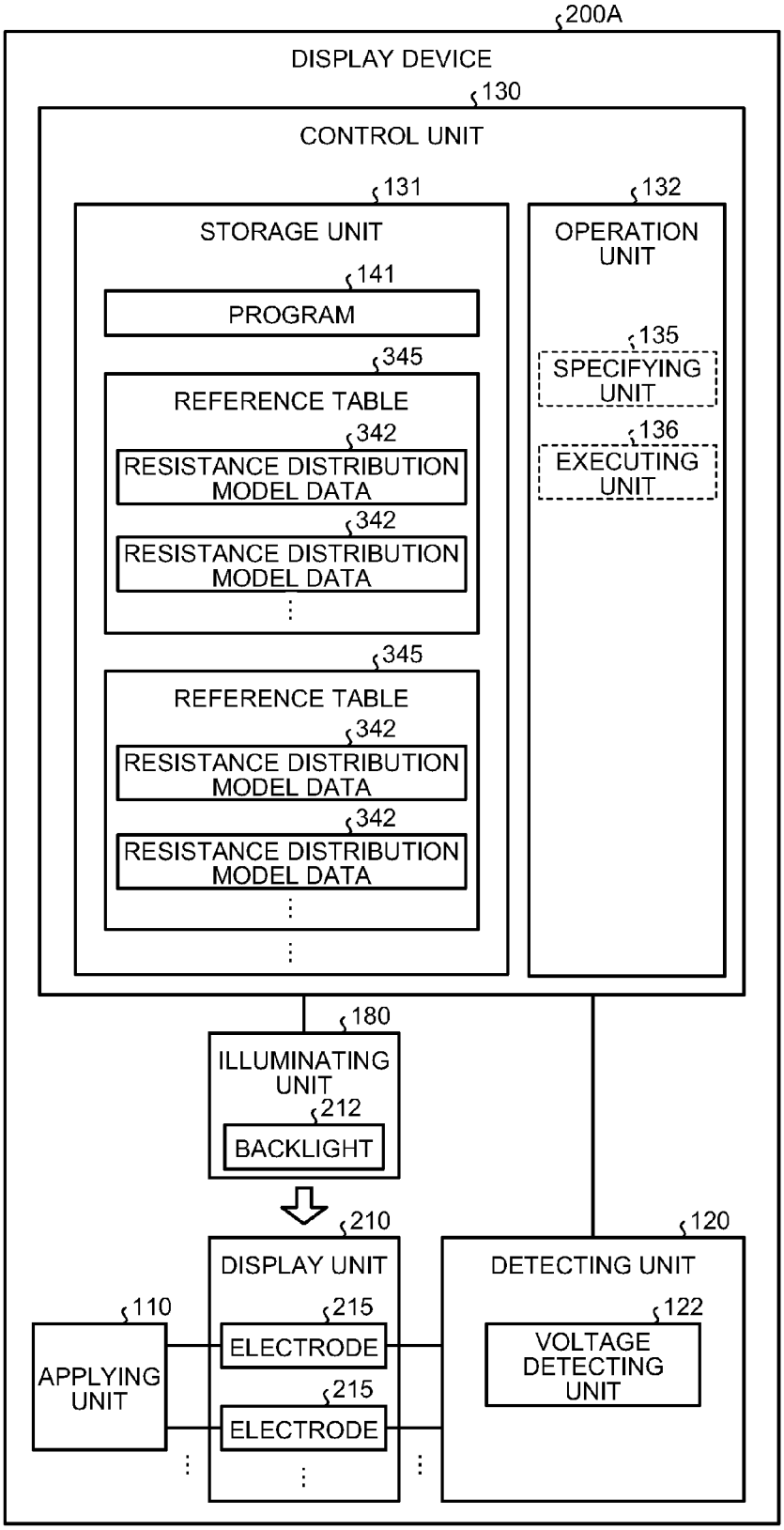
FIG. 19 is a block diagram of a configuration related to main functions of a display device according to a third embodiment.

A third embodiment of the present invention will be explained next with reference to FIG. 19 to FIG. 32. The third embodiment is one embodiment of the display device (display device 200A) according to the present invention, which is different from the second embodiment. In the third embodiment, for the components similar to at least either one of the first embodiment and the second embodiment, the same reference signs are assigned to the components, and explanation thereof may be omitted. FIG. 19 is a block diagram of a configuration related to main functions of the display device 200A according to the third embodiment. The third embodiment includes an illuminating unit 180. The illuminating unit 180 includes an illumination device that irradiates light to the display unit 210. Specifically, the illuminating unit 180 includes, for example, a backlight 212 that illuminates the light to the display unit 210; however, this configuration is only an example of the specific configuration of the illuminating unit 180. Therefore the embodiment is not limited thereto, and the configuration can be appropriately modified. In the second embodiment, although the description of the illuminating unit 180 is omitted, the display device according to the second embodiment also includes, for example, the illuminating unit 180 with the backlight 212 or the like similar to the third embodiment.

The applying unit 110 according to the third embodiment outputs a pulse signal, to the electrode 215, in which a pulse rises during the first predetermined time (for example, 200 ms) and thereafter the pulse falls during the second predetermined time (for example, 100 ms). The detecting unit 120 according to the third embodiment includes a voltage detecting unit 122 that detects a voltage value of the electrode 215. The detecting unit 120 causes the voltage detecting unit 122 to detect a change of the voltage value occurring due to the electric signal applied by the applying unit 110. The detecting unit 120 outputs the signal indicating the detected electrical change (change of the voltage value) to the control unit 130.

The storage unit 131 according to the third embodiment stores resistance distribution model data 342. The resistance distribution model data 342 is data indicating a relationship between a distribution (resistance distribution) of electrical resistance values in portions of the electrode 215 that can be calculated based on the detection result of the voltage value of the electrode 215 and a temperature distribution of the electrode 215. In the third embodiment, among a plurality of pieces of resistance distribution model data 342, pieces of resistance distribution model data 342 whose equilibrium voltage values (explained later) are the same as each other are combined into one reference unit (for example, a reference table 345). The specifying unit 135 according to the third embodiment specifies, from the information indicating a change in the voltage value detected by the detecting unit 120, the resistance distribution model data 342 corresponding to the change. Specifically, the operation unit 132 that functions as the specifying unit 135 in the third embodiment calculates an integrated value of the electrical change (change of the voltage value) for the pulse signal output from the applying unit 110, and specifies the resistance distribution model data 342 corresponding to an equilibrium voltage value in the change of the voltage value and to the calculated integrated value.

The executing unit 136 according to the third embodiment executes a command to attenuate the irradiation to the display unit 210 based on the temperatures of the electrodes 215. Specifically, for example, when part or all of the electrodes 215 exceeds a second temperature (e.g., 80° C.), the executing unit 136 outputs a command to reduce the irradiation amount of the illuminating unit 180 to the illuminating unit 180. The illuminating unit 180 operates according to the command and reduces the irradiation amount to the display unit 210. This enables to prevent occurrence of disturbance in display caused by the increase in the temperature due to the irradiation of the light to the display unit 210.

Figure 20:
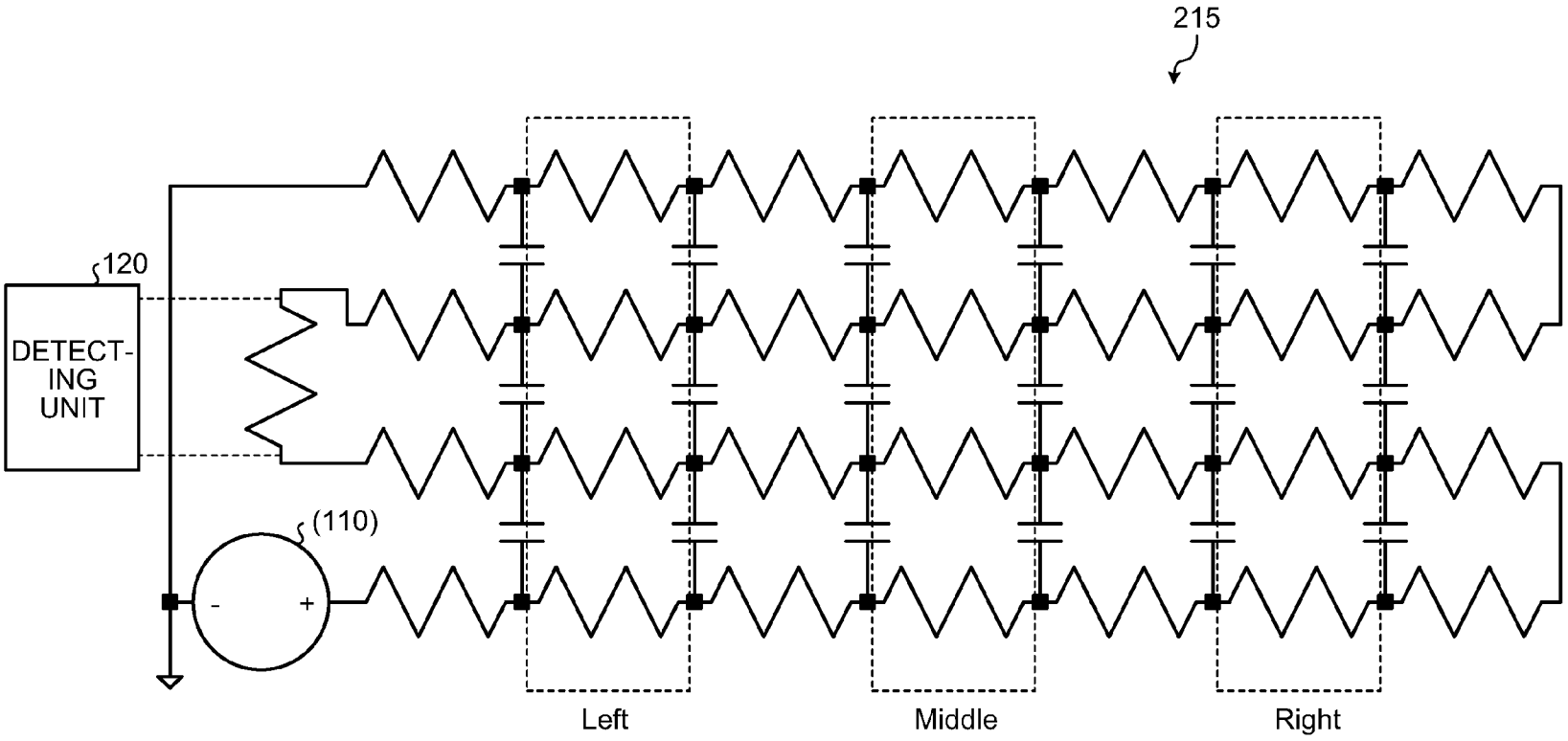
FIG. 20 is a diagram of an example of a calculation model of one electrode.

FIG. 20 is a diagram of an example of a calculation model of one electrode 215. As illustrated in FIG. 20, a portion, of the electrode 215, closer to its both ends coupled to the applying unit 110 and the detecting unit 120 is described as "Left" side, a portion of the electrode 215 away from its both ends coupled to the applying unit 110 and the detecting unit 120 is described as "Right" side, and a portion between the "Left" side and the "Right" side is described as "Middle" side.

Figure 21:
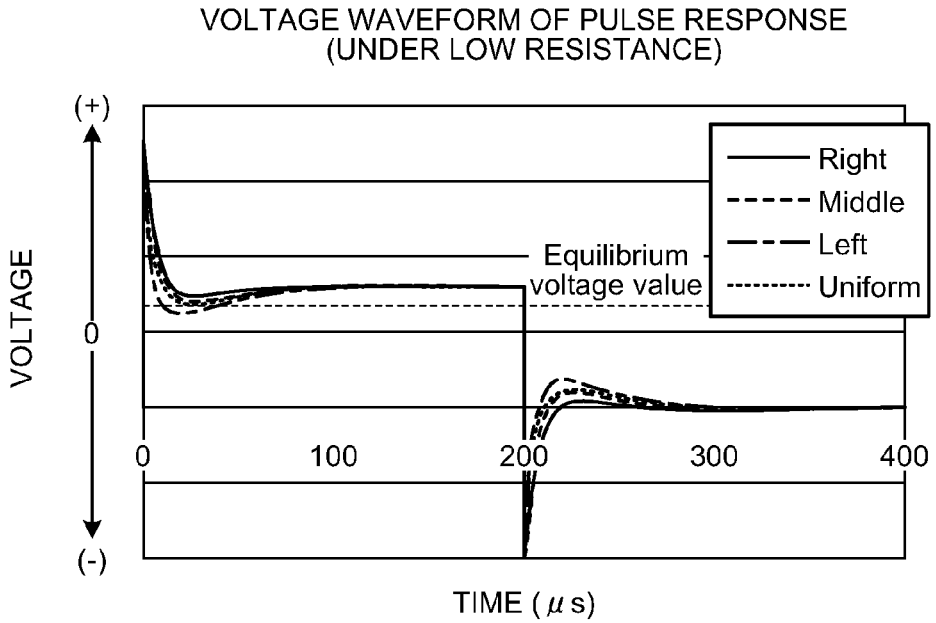
FIG. 21 is a diagram of an example of voltage waveforms corresponding to change patterns of a pulse response under low resistance.
Figure 22:
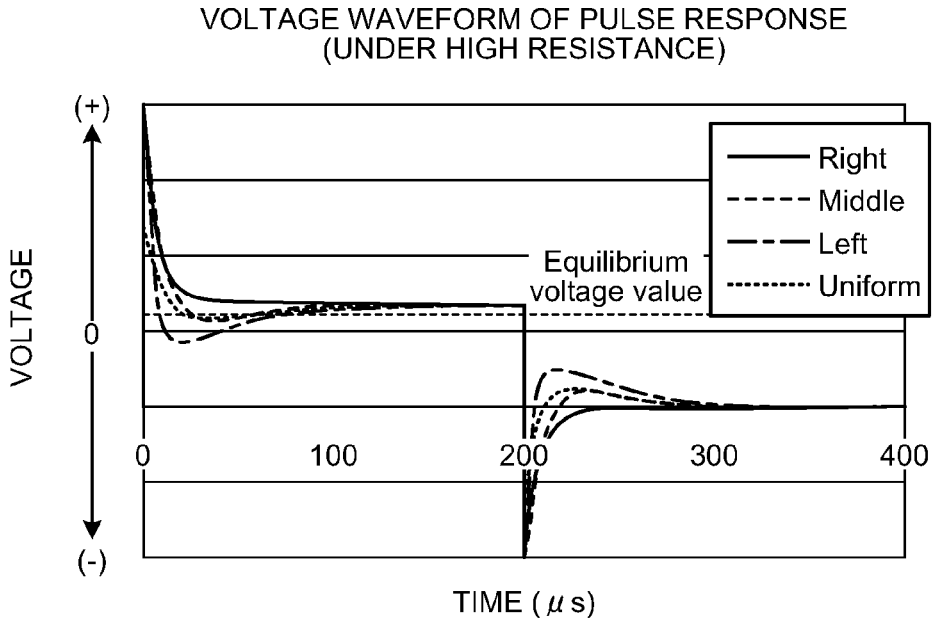
FIG. 22 is a diagram of an example of voltage waveforms corresponding to change patterns of a pulse response under high resistance.

FIG. 21 is a diagram of an example of voltage waveforms corresponding to change patterns of a pulse response under low resistance. FIG. 22 is a diagram of an example of voltage waveforms corresponding to change patterns of a pulse response under high resistance. The description of "Under low resistance" and "Under high resistance" in FIG. 21 and FIG. 22 is description based on a relative comparison of electrical resistance values which are mutually different from each other and are included in a plurality of electrical resistance values that can appear only as electrical resistance values of the electrode 215. As illustrated in FIG. 21 and FIG. 22, the voltage value detected by the detecting unit 120 at the time of low resistance is higher as compared with that at the time of high resistance. The difference between "Under low resistance" and "Under high resistance" is based on the levels of the equilibrium voltage value at the pulse-on time. The equilibrium voltage value according to the third embodiment corresponds to the electrical resistance value of the entire electrode 215 similar to the equilibrium current value according to the second embodiment. Therefore, similarly to the second embodiment, the resistance distribution model data 342 can be narrowed down using the equilibrium voltage value also in the third embodiment. In other words, the reference table 345 is aggregate data obtained by grouping the resistance distribution model data 342 corresponding to the detection result indicating the same equilibrium voltage values, and functions as one reference unit.

Figure 23:
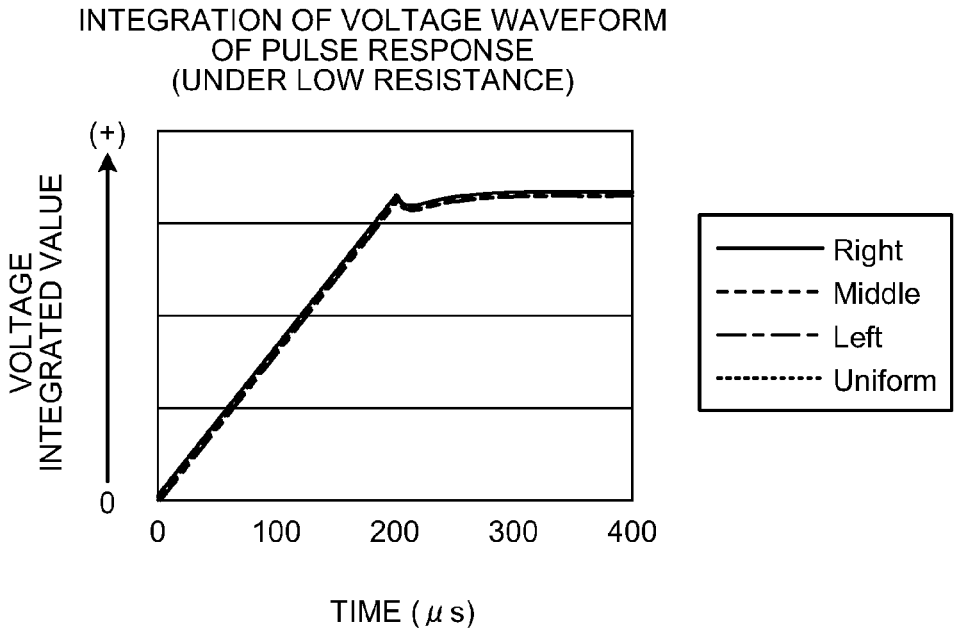
FIG. 23 is a diagram of integration of the voltage value indicated by the change patterns illustrated in FIG. 21.
Figure 24:
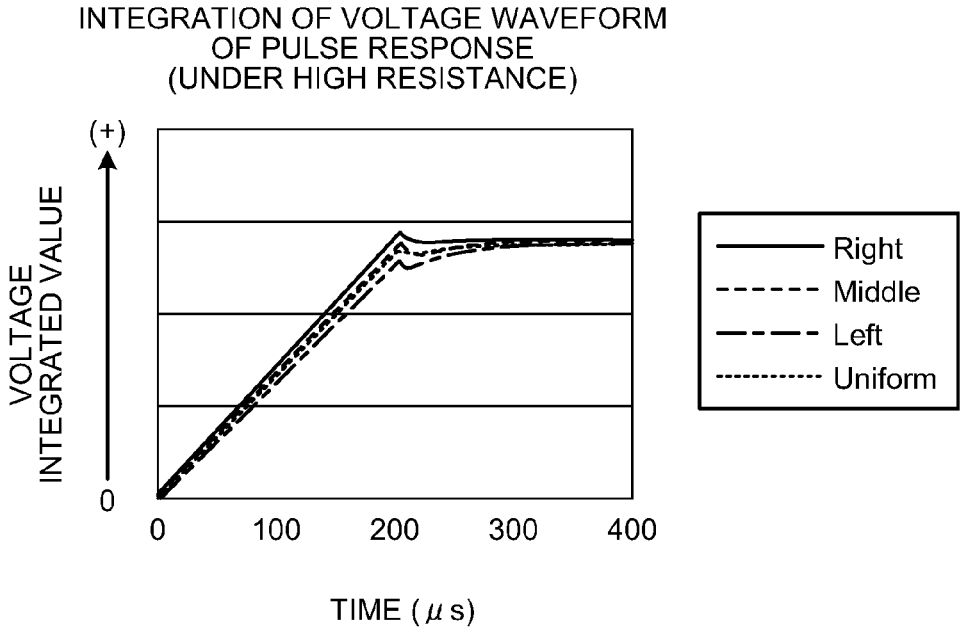
FIG. 24 is a diagram of integration of the voltage value indicated by the change patterns illustrated in FIG. 22.

For example, the integrated values in changes of the voltage values indicated by the electrode 215 with respect to the pulse-on and the pulse-off as illustrated in FIG. 21 and FIG. 22 are represented as graphs as illustrated in FIG. 23 and FIG. 24. Change curves of the voltage values attached with "Right", "Middle", "Left", and "Uniform" are described respectively in FIG. 21 and FIG. 22. This is because when the same equilibrium voltage values are to be detected, the change patterns of the voltage values become different from each other when the temperatures on the entire electrode 215 are "Uniform" or when the temperature at any one of the portions on the "Right" side, the "Middle" side, and the "Left" side of the electrode 215 is higher than the other portions. The "Uniform" in the third embodiment indicates that the temperatures of the portions set at a plurality of different locations (e.g., three locations of "Right", "Middle", and "Left") in the Y direction of the electrode 215 are substantially the same as each other in the temperature resolution based on the correlation with the voltage values (electrical resistance values), or that a difference between the temperatures of the portions is within a predetermined range (e.g., 1° C. or lower).

The characters attached to the voltage waveforms illustrated in FIG. 21 and FIG. 22 indicate the portions at high temperature on the electrode 215 (or the temperatures are uniform on the entire electrode 215). In other words, the voltage waveforms illustrated in FIG. 21 and FIG. 22 can be the change patterns of the voltage value each corresponding to each of the pieces of the resistance distribution model data 342 included in one reference unit (e.g., the reference table 345).

FIG. 23 is a diagram of integration of the voltage value indicated by the change pattern illustrated in FIG. 21. FIG. 24 is a diagram of integration of the voltage value indicated by the change pattern illustrated in FIG. 22. The operation unit 132 calculates an integration (time integration) of the voltage value when the change patterns illustrated in FIG. 21 and FIG. 22 are detected. Thereby each integration of voltage values illustrated in FIG. 23 and FIG. 24 can be obtained.

Figure 25:
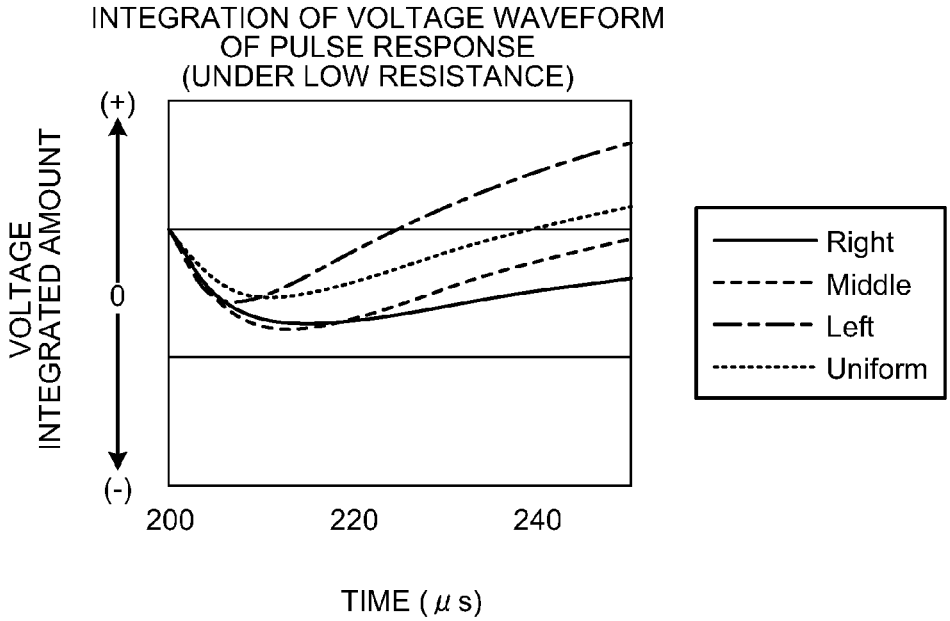
FIG. 25 is a diagram of a minimum value in changes of the voltage value obtained from the integration of the voltage value after 200 microseconds (μs) to 250 microseconds (μs) since the start of pulse-on, among the voltage values illustrated in FIG. 21.
Figure 26:
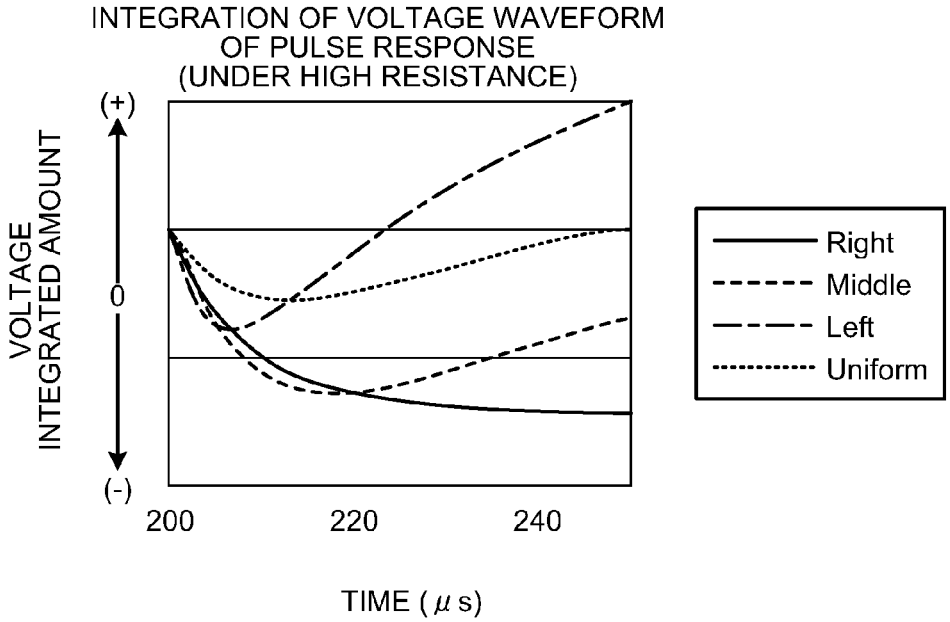
FIG. 26 is a diagram of a minimum value in changes of the voltage value obtained from the integration of the voltage value after 200 μs to 250 μs since the start of pulse-on, among the voltage values illustrated in FIG. 22.

FIG. 25 is a diagram of a minimum value in changes of the voltage value obtained from the integration of the voltage value after 200 μs to 250 μs since the start of pulse-on, among the voltage values illustrated in FIG. 21. FIG. 26 is a diagram of a minimum value in changes of the voltage value obtained from the integration of the voltage value after 200 μs to 250 μs since the start of pulse-on, among the voltage values illustrated in FIG. 22. The voltage integrated amount in FIG. 25 and FIG. 26 indicates a minimum value of the change amount based on a voltage integrated value at the pulse-off time. As illustrated in FIG. 25 and FIG. 26, a magnitude relationship between the minimum values of the changes in the voltage value after the pulse-off obtained from the integration of the voltage value becomes like "Middle"<"Right"<"Left"<"Uniform". This, in other words, indicates that the minimum value in the change of the voltage value after the pulse-off becomes the lowest when the temperature at the portion of "Middle" is high, that the minimum value becomes higher each time the portion at high temperature shifts to "Right" and "Left", and that the minimum value becomes the highest when the temperatures of the portions are "Uniform". Therefore, the specifying unit 135 can specify the temperature distribution of the electrode 215 by using the minimum value in the change of the voltage value after the pulse-off.

Figure 27:
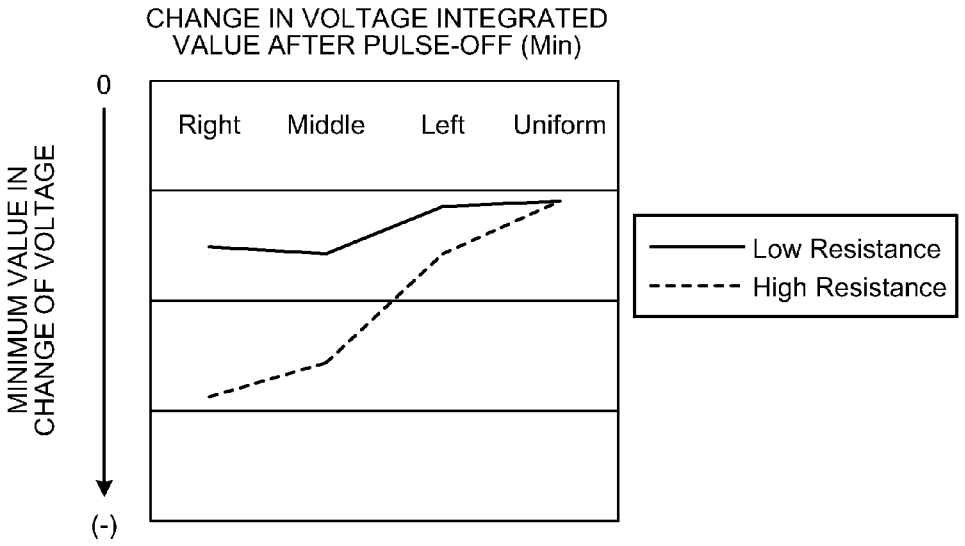
FIG. 27 is a diagram of an example of the minimum values in changes of the voltage value obtained from the integration of the voltage value associated with each of a plurality of resistance distribution models respectively included in two reference tables.

FIG. 27 is a diagram of an example of the minimum values in changes of the voltage value obtained from the integration of the voltage value associated with each of the pieces of resistance distribution model data 342 respectively included in two reference tables 345. The graph of the minimum value illustrated in FIG. 27 includes the resistance distribution model data 342 corresponding to each point of the minimum value. Specifically, one of line graphs in FIG. 27 is formed with each point of the minimum value indicated by the pieces of resistance distribution model data 342 included in one reference table 345 and with a segment obtained by connecting the points through interpolation processing. The graphs illustrated in FIG. 27 correspond to the voltage waveforms illustrated in FIG. 21 and FIG. 22. The specifying unit 135 calculates the equilibrium voltage value and the minimum value in the change of the voltage value after the pulse-off from the result of detection performed by the detecting unit 120. The specifying unit 135 specifies the reference table 345 corresponding to the equilibrium voltage value. By graphing the minimum values in the changes of the voltage values after the pulse-off indicated by the pieces of resistance distribution model data 342 included in the reference table 345 specified herein, for example, the graph as one of the line graphs illustrated in FIG. 27 is obtained. The specifying unit 135 specifies the resistance distribution model data 342 corresponding to the minimum value in the change of the voltage value after the pulse-off calculated from the result of detection performed by the detecting unit 120, among the pieces of resistance distribution model data 342 included in the specified reference table 345. The specifying unit 135 determines the temperature distribution of the electrode 215 indicated by the specified resistance distribution model data 342 as the temperature distribution at the time of detection performed by the detecting unit 120.

Figure 28:
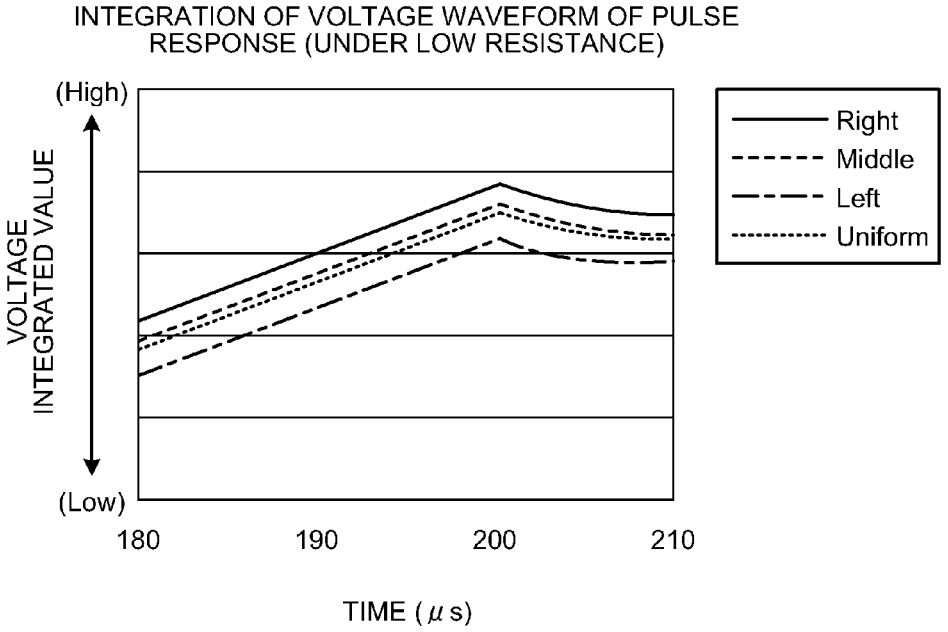
Figure 29:
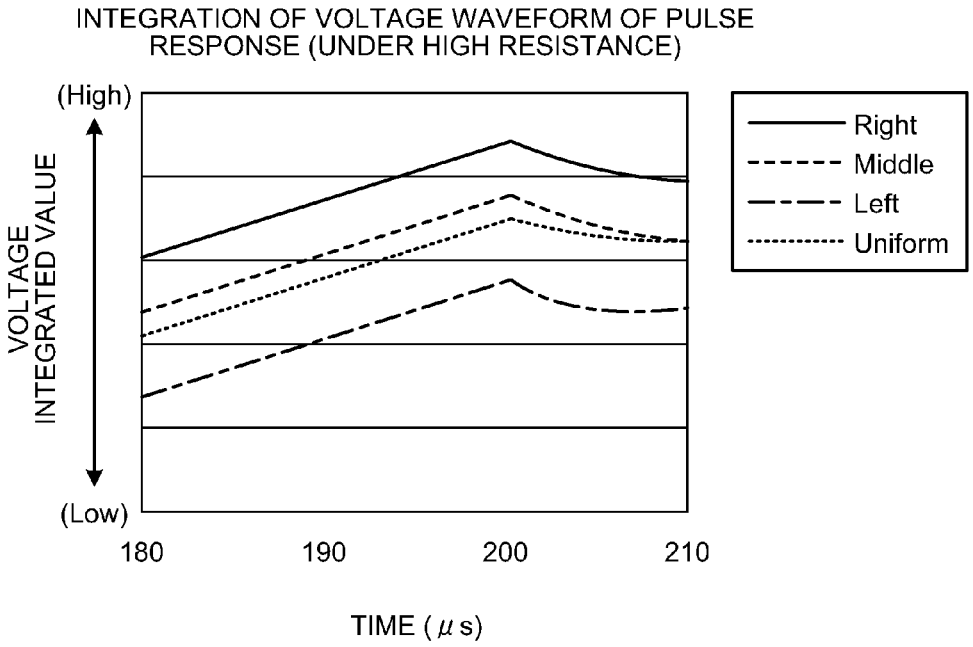

The method of specifying the temperature distribution of the electrode 215 based on the change of the voltage value is not limited to the method of using the minimum value in the change of the voltage value after the pulse-off. FIG. 28 is an enlarged diagram of integration of the voltage waveform, of the integration of the voltage waveform illustrated in FIG. 23, after 180 μs to 210 μs since the start of pulse-on. FIG. 29 is an enlarged diagram of integration of the voltage waveform, of the integration of the voltage waveform illustrated in FIG. 24, after 180 μs to 210 μs since the start of pulse-on. Even under the conditions where the same equilibrium voltage values can be obtained as illustrated in FIG. 21 and FIG. 22, the integrations of the voltage waveform become different according to the position of a high temperature portion in the electrode 215 as illustrated in FIG. 28 and FIG. 29. Specifically, the voltage integrated value becomes larger when the temperature at a portion ("right" side) away from the both ends is high, and the voltage integrated value becomes smaller when the temperature at a portion ("left" side) closer to the both ends is high. Therefore, the specifying unit 135 can specify the temperature distribution of the electrode 215 using the voltage integrated value.

Figure 30:
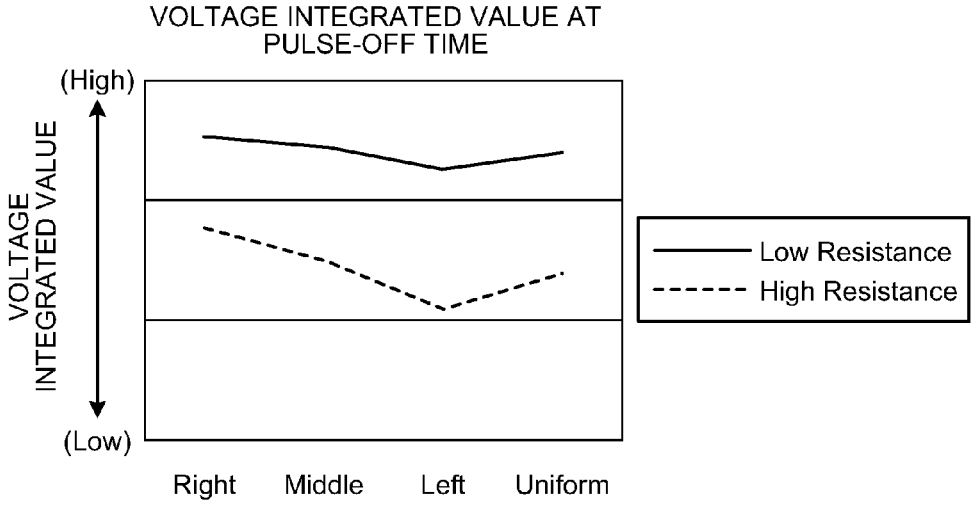
FIG. 30 is a diagram of an example of a voltage integrated value associated with each of the resistance distribution models respectively included in the two reference tables.

FIG. 30 is a diagram of an example of the voltage integrated value associated with each of the pieces of resistance distribution model data 342 respectively included in the two reference tables 345. The graph of the voltage integrated value illustrated in FIG. 30 are actually points indicating a plurality of voltage integrated values. The reference table 345 includes the resistance distribution model data 342 corresponding to each point of the voltage integrated value i.e. data indicating a correspondence between the electrical resistance value at each portion of the electrode 215 and the temperature at each portion of the electrode 215. One of the line graphs in FIG. 30 corresponds to one of the reference tables 345. Specifically, one of the line graphs in FIG. 30 is formed with points of the voltage integrated value indicated by the pieces of resistance distribution model data 342 included in one of the reference tables 345 and with a segment obtained by connecting the points through the interpolation processing. The graph illustrated in FIG. 30 corresponds to the voltage waveforms illustrated in FIG. 21 and FIG. 22. The specifying unit 135 calculates an equilibrium voltage value and a voltage integrated value after the pulse-off from the result of detection performed by the detecting unit 120. The specifying unit 135 specifies the reference table 345 corresponding to the equilibrium voltage value. By graphing the voltage integrated values after the pulse-off each indicated by each of the pieces of resistance distribution model data 342 included in the specified reference table 345, for example, one graph of the line graphs illustrated in FIG. 30 is obtained. The specifying unit 135 specifies the resistance distribution model data 342 corresponding to the voltage integrated value after the pulse-off calculated from the result of detection performed by the detecting unit 120, among the pieces of resistance distribution model data 342 included in the specified reference table 345. The specifying unit 135 determines the temperature distribution of the electrode 215 indicated by the specified resistance distribution model data 342 as the temperature distribution at the time of detection performed by the detecting unit 120.

In the example illustrated in FIG. 30, the result of comparison between the voltage integrated values after 210 ms since the start of the pulse-on at the time of high resistance becomes like "Left"<"Middle" ≅"Uniform"<"Right". In this way, only the voltage integrated values may cause a situation such that a case where the high temperature potion is "Middle" and a case where the temperatures at the portions are "Uniform" are difficult to be discriminated. Moreover, when the temperature distribution of the electrode 215 is specified by using the minimum value in the change of the voltage value after the pulse-off as illustrated in FIG. 27, there may occur patterns which are difficult to be discriminated (for example, patterns difficult to be discriminated between the case where the high temperature portion at the time of high resistance is "Left" and the case where the temperatures at the portions are "Uniform"). For this reason, there may be a case where, by using only either one of the minimum value in the change of the voltage value after the pulse-off and the voltage integrated value, the temperature distribution of the electrode 215 may be difficult to be specified. In this case, it may be configured to further improve the accuracy of specifying the temperature distribution of the electrode 215 by using the both of them. Specifically, for example, the specifying unit 135 may adopt a specification result that matches either one of a specification result of the temperature distribution of the electrode 215 based on the minimum value in the change of the voltage value after the pulse-off and a specification result of the temperature distribution of the electrode 215 based on the voltage integrated value. When there is no specification result that matches, the specifying unit 135 may adopt the specification result indicating, for example, the temperature distribution that is most similar to the temperature distribution included in the specification results of the temperature distribution of the electrode 215 based on the voltage integrated value, of the specification results of the temperature distribution of the electrode 215 based on the minimum value in the change of the voltage value after the pulse-off. These specific specification methods are merely examples, and can be modified as required. For example, it may be configured to separately provide the resistance distribution model data 342 (and the reference table 345) used for the method of specifying the temperature distribution based on the minimum value in the change of the voltage value after the pulse-off and the resistance distribution model data 342 (and the reference table 345) used for the method of specifying the temperature distribution based on the voltage integrated value, and to define a corresponding specification result like "Left", "Middle", "Uniform", or "Right" only in a range in which the specification results of the temperature distributions are determined to one using the respective specification methods. In this case, the range in which the specification results of the temperature distributions are not determined to one using the respective specification methods is invalidated or deleted as noise. However, a relationship between the minimum value, the voltage integrated value, and the specification result of the temperature distribution may be previously defined so that when the detecting unit 120 detects the detection result corresponding to the portion determined as noise in one of the resistance distribution model data 342 used for the method of specifying the temperature distribution based on the minimum value in the change of the voltage value after the pulse-off and the resistance distribution model data 342 used for the method of specifying the temperature distribution based on the voltage integrated value, the temperature distribution can be specified without the determination as noise in the other one. With this definition, the temperature distribution of the electrode 215 can be specified using at least either one of the minimum value in the change of the voltage value after the pulse-off and the voltage integrated value even if any detection result is obtained.

Specifically, the resistance distribution model data 342 according to the third embodiment is data indicating a combination pattern of the equilibrium voltage value, the voltage integrated value after the pulse-off, and the minimum value in the change of the voltage value after the pulse-off, and indicating a temperature distribution of the electrode when the combination pattern is established. Therefore, the temperature distribution of the electrode 215 can be specified by detecting the electrical change (the equilibrium voltage value indicated by the change of the voltage value and the change of the voltage value after the pulse-off) according to the temperatures at the portions of the electrode 215 and specifying the resistance distribution model data 342 corresponding to at least any one of the equilibrium voltage value indicated by the detected electrical change, the voltage integrated value after the pulse-off, and the minimum value in the change of the voltage value after the pulse-off.

More specifically, in the third embodiment, the specifying unit 135 specifies the temperature distribution of the electrode 215 based on, for example, the minimum value in the change of the voltage value after the pulse-off. Here, if it is difficult to determine the temperature distributions of the electrode 215 to one, the specifying unit 135 further specifies the temperature distribution of the electrode 215 based on the voltage integrated value, and specifies the temperature distribution that matches or is most similar to the temperature distribution of the electrode 215 specified based on the minimum value in the change of the voltage value after the pulse-off. Obviously, this specification method is only an example and can be modified appropriately. For example, it may be configured that the specifying unit 135 refers to all the resistance distribution model data 342 included in the reference table 345 corresponding to the equilibrium voltage value based on the minimum value in the change of the voltage value after the pulse-off, definitely determines one resistance distribution model data 342 corresponding to the minimum value that matches or is most similar to the minimum value, and specifies the temperature distribution indicated by the one resistance distribution model data 342 as the temperature distribution of the electrode 215. In this example, there is no need to specify the temperature distribution using the voltage integrated value. As another example, it may be configured that the specifying unit 135 specifies the temperature distribution of the electrode 215 based on voltage integrated value, specifies the temperature distribution of the electrode 215 based on the minimum value in the change of the voltage value after the pulse-off if the temperature distributions of the electrode 215 are difficult to be determined to one, and specifies the temperature distribution that matches or is most similar to the temperature distribution of the electrode 215 specified based on the voltage integrated value.

Figure 31:
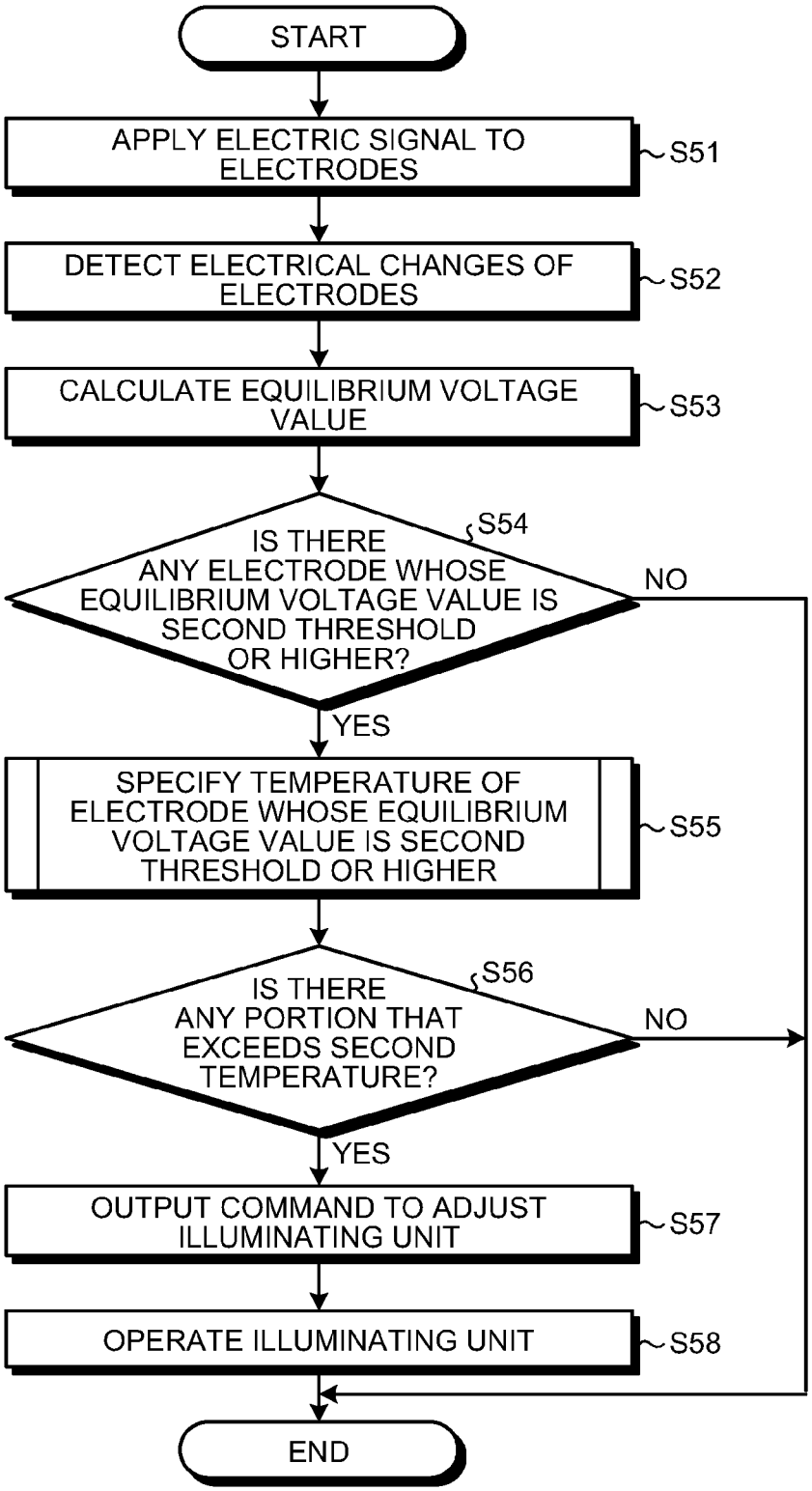
FIG. 31 is a flowchart of an example of a processing flow related to temperature information for the electrode 215 according to the third embodiment.

FIG. 31 is a flowchart of an example of a processing flow related to temperature information for the electrode 215 according to the third embodiment. The applying unit 110 applies an electric signal to the electrodes 215 (Step S51). The detecting unit 120 detects the electrical changes of the electrodes 215 occurring due to the electric signal applied at Step S51 (Step S52). In the third embodiment, the changes of the voltage values in the electrodes 215 are measured at Step S52. The specifying unit 135 calculates the equilibrium voltage value of each of the electrodes 215 (Step S53). The specifying unit 135 determines whether an equilibrium voltage value being a second threshold or higher is included in the equilibrium voltage values calculated at Step S53 (Step S54). When it is determined that all the equilibrium voltage values are less than the second threshold (No at Step S54), the processing related to the temperature information for the electrode 215 is terminated. This results in that the temperature of the electrode 215 is relatively low when the equilibrium voltage value detected by the detecting unit 120 is relatively high. However, when the equilibrium voltage value is a certain threshold (the second threshold) or higher i.e. the electrical resistance value of the entire electrode 215 is the electrical resistance value corresponding to the threshold or lower, a portion that exceeds the second temperature may not exist in the electrode 215 even if it may be any kind of temperature distribution. In this case, the executing unit 136 does not execute the command, and therefore detailed specification of the temperature distribution is not needed in terms of the operation control performed by the executing unit 136. Therefore, in the third embodiment, when the equilibrium voltage value is the second threshold or higher, the specification of the temperature distribution of the electrode 215 performed by the specifying unit 135 is omitted.

When it is determined that the equilibrium voltage value being the second threshold or higher is included (Yes at Step S54), the specifying unit 135 specifies the temperature distribution of the electrode 215 whose equilibrium voltage value is the second threshold or higher (Step S55). The executing unit 136 determines whether there is a portion that exceeds the second temperature in the temperature distribution of the electrode 215 specified at Step S55 (Step S56). When it is determined that there is a portion that exceeds the second temperature (Yes at Step S56), the executing unit 136 outputs a command to adjust the illuminating unit 180 to the illuminating unit 180 (Step S57). The illuminating unit 180 operates according to the command of Step S57 (Step S58). After the processing of Step S58 or when it is determined that there is no portion that exceeds the second temperature at Step S56 (No at Step S56), the processing related to the temperature information for the electrode 215 is terminated.

Figure 32:
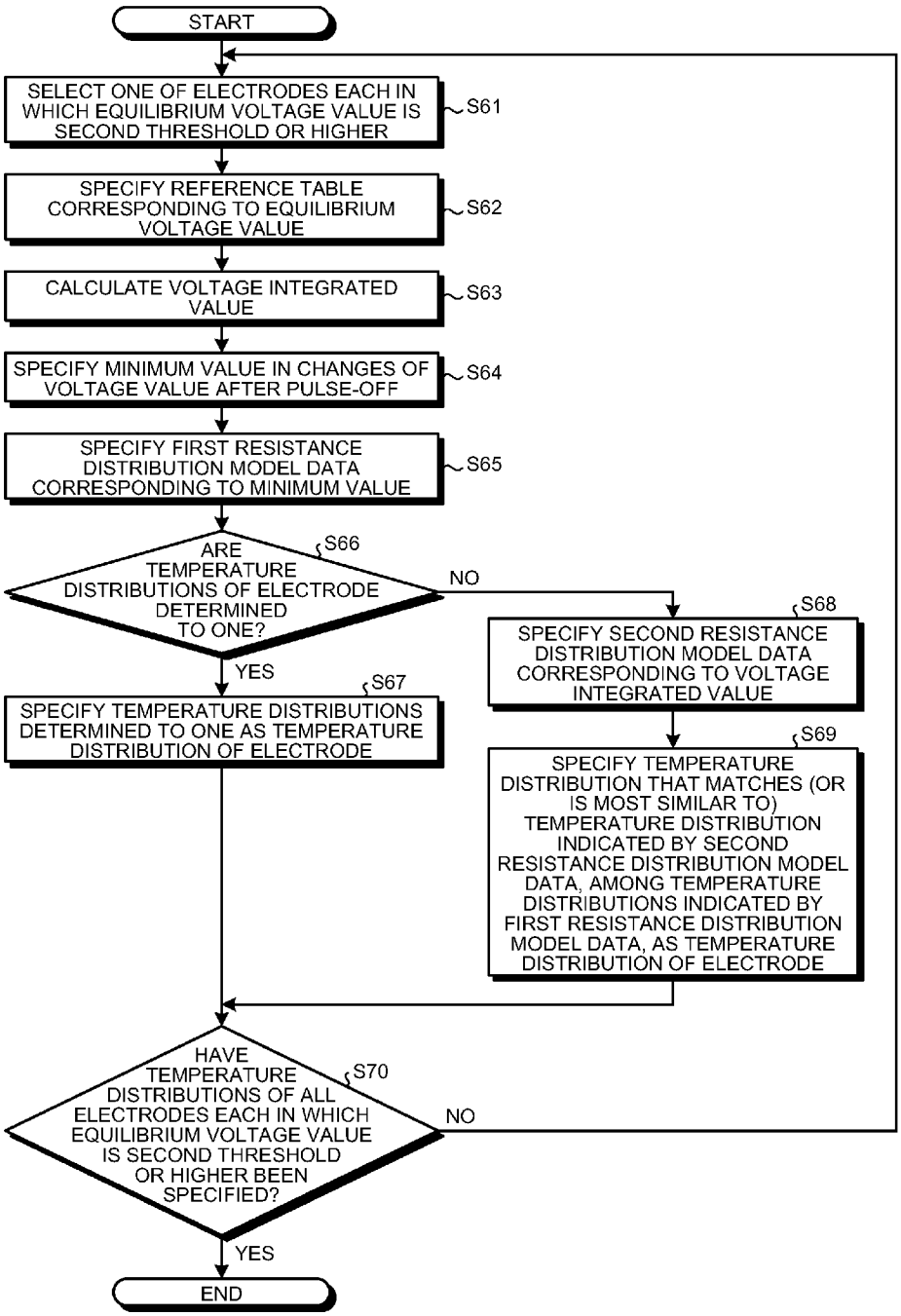
FIG. 32 is a flowchart of an example of a specific processing flow of resistance distribution model data performed by the specifying unit according to the third embodiment.

FIG. 32 is a flowchart of an example of a specific processing flow of the resistance distribution model data 342 performed by the specifying unit 135 according to the third embodiment. The flowchart illustrated in FIG. 32 is a sub-flowchart of Step S55 in the flowchart of FIG. 31. The operation unit 132 selects one electrode 215, in which information related to the temperature is not specified, of the electrodes 215 each in which the equilibrium voltage value is the second threshold or higher (Step S61). The operation unit 132 specifies the reference table 345 corresponding to the equilibrium voltage value of the electrode 215 selected at Step S61 (Step S62). The operation unit 132 calculates the voltage integrated value from the change pattern of the voltage value detected by the detecting unit 120 (Step S63). The operation unit 132 calculates the minimum value in the change of the voltage value after the pulse-off from the voltage integrated value calculated at Step S63 (Step S64). The operation unit 132 specifies the resistance distribution model data 342 (first resistance distribution model data) corresponding to the minimum value calculated at Step S64 (Step S65). The operation unit 132 determines whether the temperature distributions of the electrode 215 are determined to one by the first resistance distribution model data (Step S66). Specifically, the operation unit 132 determines whether the number of resistance distribution model data 342 corresponding to the minimum value calculated at Step S64 is one, among the resistance distribution model data 342 included in the reference table 345 specified at Step S62. When it is determined that the temperature distributions of the electrode 215 are determined to one (Yes at Step S66), the operation unit 132 specifies the temperature distributions determined to one as the temperature distribution of the electrode 215 selected at Step S61 (Step S67). Meanwhile, when the temperature distributions of the electrode 215 are not determined to one, in other words, the pieces of resistance distribution model data 342 correspond to the first resistance distribution model data (No at Step S66), the operation unit 132 specifies the resistance distribution model data 342 (second resistance distribution model data) corresponding to the voltage integrated value of the electrode 215 selected at Step S61, among the pieces of resistance distribution model data 342 included in the reference table 345 specified at Step S62 (Step S68). The operation unit 132 specifies the temperature distribution that matches or is most similar to the temperature distribution, indicated by the second resistance distribution model data, among the temperature distributions indicated by the pieces of resistance distribution model data 342 corresponding to the first resistance distribution model data, as the temperature distribution of the electrode 215 selected at Step S61 (Step S69). After the processing of Step S67 or the processing of Step S69, the operation unit 132 determines whether the temperature distributions of all the electrodes 215 each in which the equilibrium voltage value is the second threshold or higher have been specified (Step S70). When the temperature distributions of not all the electrodes 215 have been specified (No at Step S70), the processing shifts to Step S61. When the temperature distributions of all the electrodes 215 have been specified (Yes at Step S70), the operation unit 132 ends the processing of specifying the resistance distribution model data 342.

In this way, the specifying unit 135 specifies the temperature distribution of the electrode 215 in the Y direction based on the equilibrium voltage value of the electrode 215 applied with the electric signal and the change in the voltage value occurring after the electric signal applied state is changed to the non-applied state.

As explained above, according to the third embodiment, the temperature distribution of each of the electrodes 215 can be specified more accurately by using the integration of the voltage value in addition to the effects of the first embodiment and the second embodiment.

In the third embodiment, when part or all of the electrodes 215 exceeds the second temperature (e.g. 80° C.), the irradiation amount of the illuminating unit 180 is reduced. However, this configuration is only one aspect of the execution of the command according to the temperature of the electrode 215 and is not limited thereto, and therefore, the embodiment can be modified appropriately. For example, it may be configured to provide a cooling unit with a fan or the like that cools the display unit and operate the cooling unit when the temperature increases, for example, when the temperature exceeds the second temperature.

4. Application Examples

Application examples of the display device as explained in the embodiments will be explained next with reference to FIG. 33 to FIG. 39. The display device as explained in the embodiments can be applied to electronic apparatuses in all areas such as a head-up display (HUD), a car-mounted display device, a smartphone, and the like. In other words, the display device can be applied to electronic apparatuses in all areas that display an externally input video signal or an internally generated video signal as an image or a video.

Application Example 1

Figure 33:
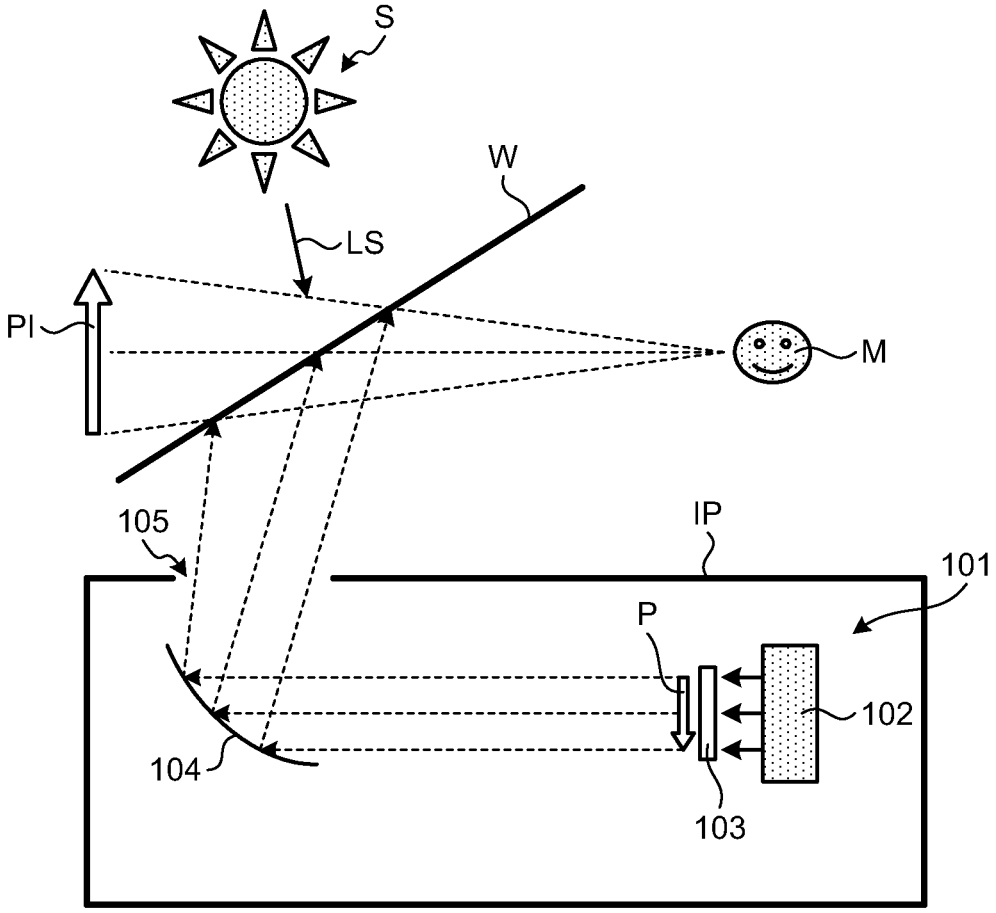
FIG. 33 is a schematic view of a head-up display to which the display device according to the present invention is applied.

FIG. 33 is a schematic view of a HUD 101 to which the display device according to the present invention is applied. The HUD 101 is mounted on vehicles such as cars, buses, and trucks, and displays information on a projection surface, for example, on a windshield of a vehicle. A driver M of the vehicle can visually recognize the information displayed on a windshield W without turning away from the foreground.

The HUD 101 includes a light source 102, a display device 103, and a mirror 104. The light source 102 is an example of the illuminating unit 180, and is, for example, a light-emitting diode (LED), but is not limited thereto. The display device 103 is an example of the display unit 210, and is a liquid crystal panel, but is not limited thereto. The mirror 104 is a concave mirror which is used to project an image of the display device on a projection plane, for example, on the windshield W. The mirror 104 is not an essential component, and therefore an image of the display device may be directly projected on the windshield W. Moreover, the image may be projected to the windshield W through a plurality of mirrors 104. The HUD 101 has an opening 105 provided opposite to the windshield W and to the mirror 4.

An image P projected by the display device 103 is reflected by the mirror 104 to pass through the opening 105 and is projected to the windshield W. The mirror 104 enlarges the image P to be projected to the windshield W. The driver M visually recognizes a virtual image PI of the image P projected by the display device 103 through the windshield W.

Light (sunlight) LS from the sun S is irradiated to the windshield W of the vehicle. The sunlight LS irradiated to the windshield W passes through the opening 105 of the HUD 101 to be reflected by the mirror 104, and is irradiated to the display device 103. As explained above, the mirror 104 enlarges the image P displayed by the display device 103 at the time of its reflection and projects the enlarged image to the windshield W. Therefore, the sunlight LS from the windshield W is reduced by the mirror 104 and is irradiated to the display device 103.

The temperature of the display device 103 is increased by infrared rays contained in the sunlight LS. The sunlight LS is condensed by the mirror 104, and therefore the energy density of the infrared rays irradiated to the display device 103 is increased. Because it is stored in a front panel IP of the vehicle, the display device 103 is used under an environment where it is easily filled with heat. Therefore, the display device 103 is used under the environment where the temperature is easily increased. The display device 103, which is irradiated with light from the light source 102, is formed with the display device according to the embodiments. This enables acquisition of the temperature information for the display surface and operation control of the display unit 210 according to the temperature.

In the HUD 101, the sunlight LS condensed by the mirror 104 tends to be more concentrated at a center portion of the display surface of the display device 103. Therefore, the electrodes 215 may be arranged only at the center portion or the like in the X direction of the display surface where the temperature is easily increased. Moreover, it may be configured to intensively and more densely arrange a larger number of electrodes 215 in the portion while totally arranging the electrodes 215 in the X direction of the display surface.

Application Example 2

The electrode that forms the present invention and the electrode for touch detection in a display device with a touch detection function can be in a shared relationship. Specifically, touch detection electrodes in a capacitive touch panel can be used as electrodes that form the present invention. In other words, in the display device with an input function according to the present invention, electrodes related to an input function and electrodes related to acquisition of information for temperature can be shared. Common electrodes for display or drive electrodes used to implement a touch detection function, not limited to the touch detection electrode, can be used as electrodes that form the present invention. It may also be configured to arrange electrodes that function as the touch detection electrodes in a matrix and drive each of the electrodes to perform touch detection, or it may be configured that part of the electrodes formed into a shape of electrodes according to the present invention serves as a touch detection electrode and a temperature sensor.

Figure 34:
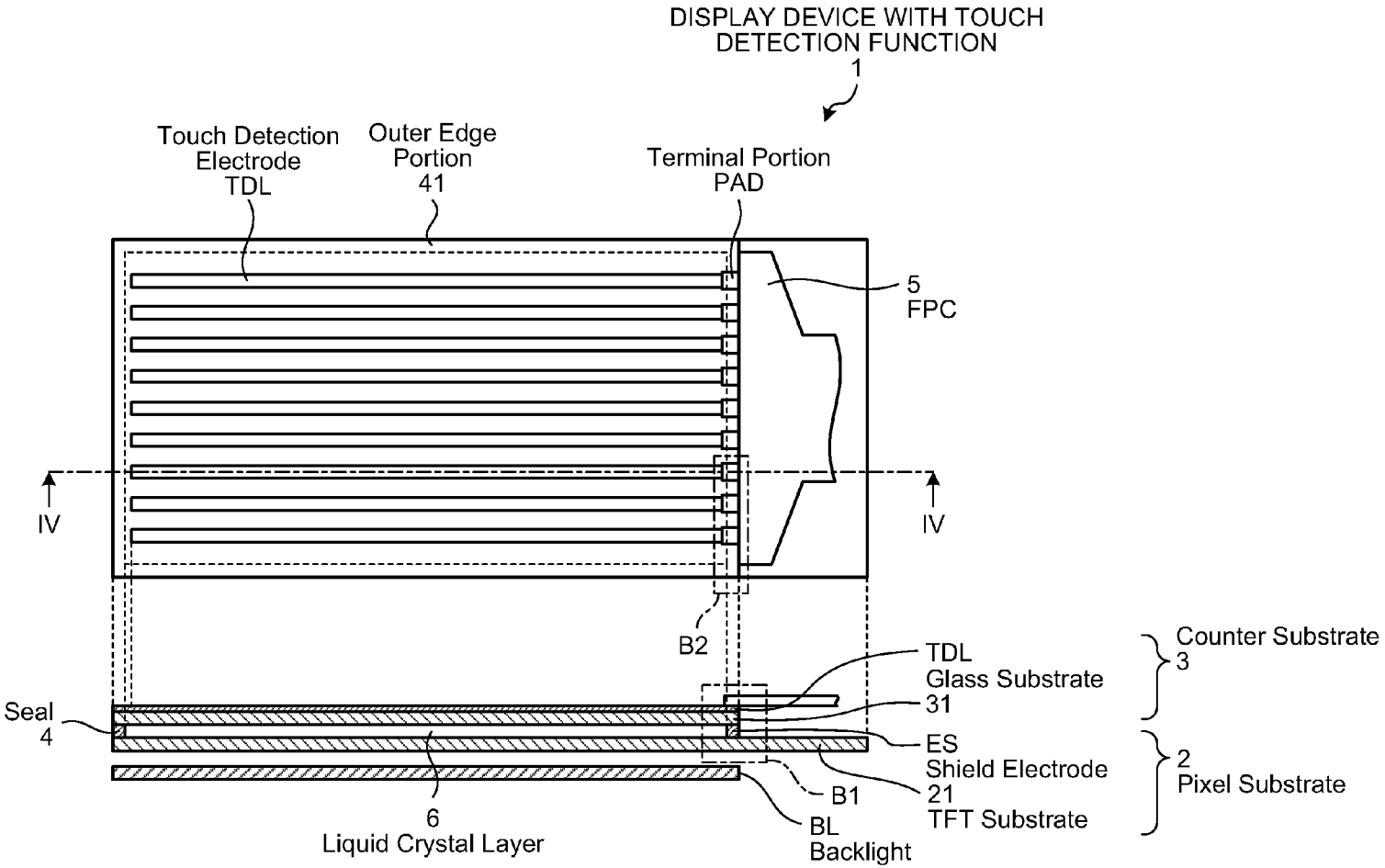
FIG. 34 is a diagram of a configuration example of a display device with a touch detection function according to an embodiment of the present invention.
Figure 35:
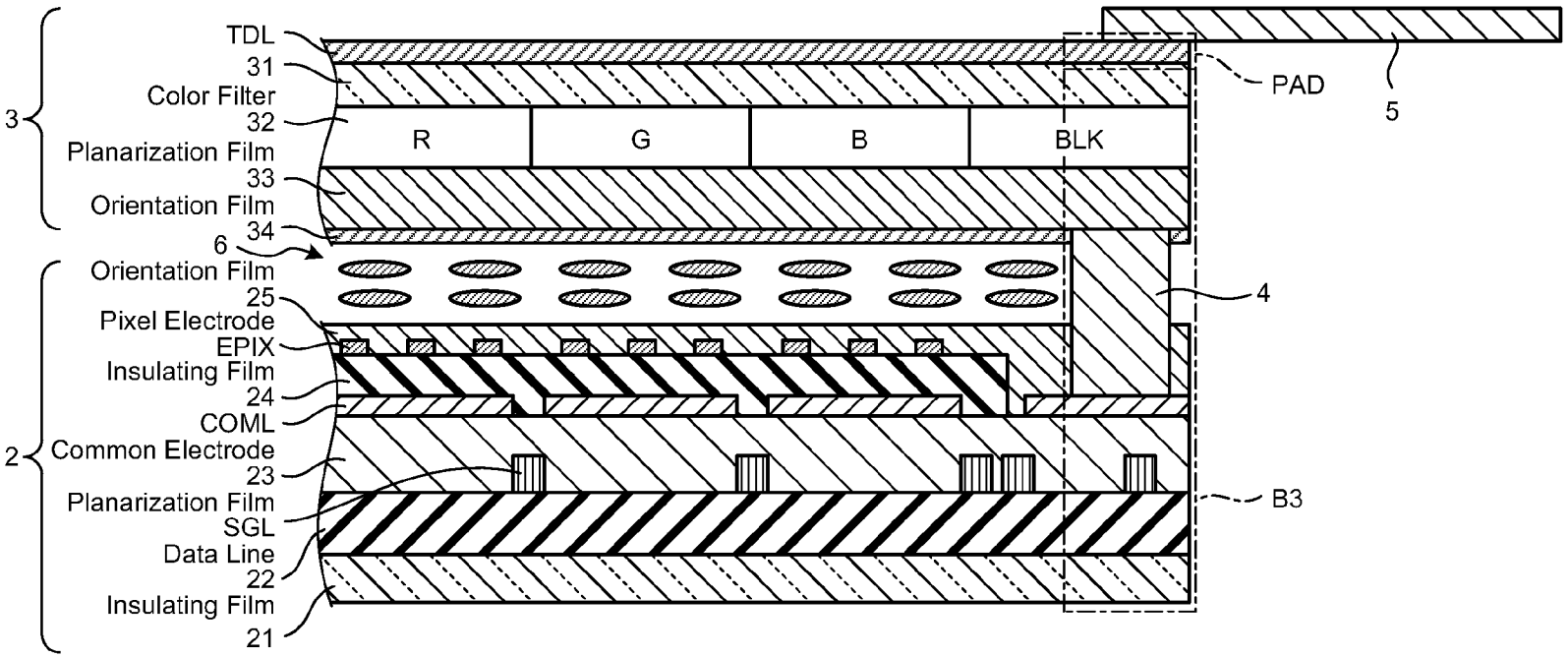
FIG. 35 is a diagram representing an example of a cross-sectional structure of a main portion (portion B1) in FIG. 34.
Figure 36:
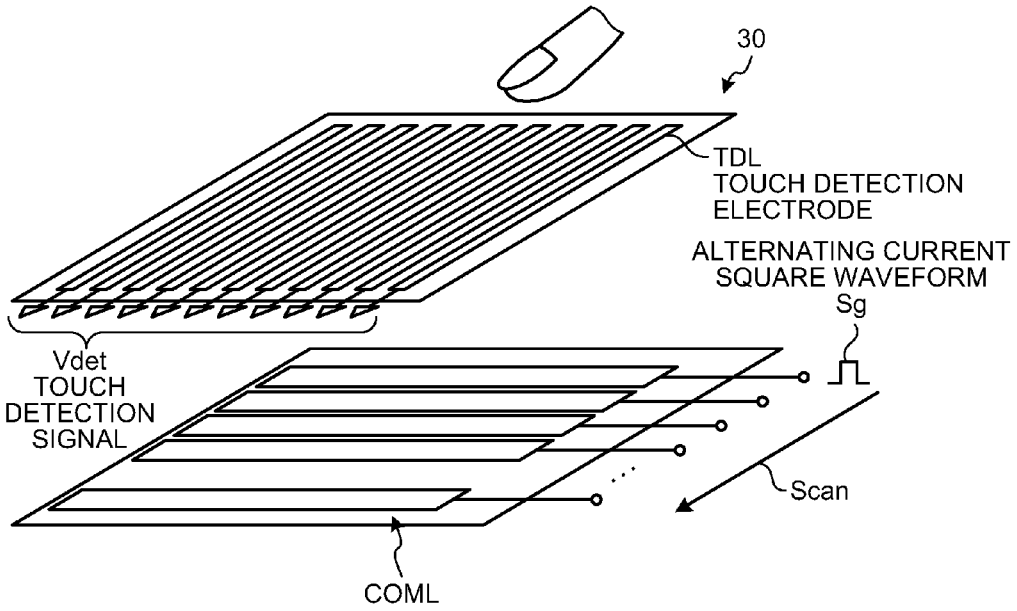
FIG. 36 is a perspective view representing a configuration example of driving electrodes and touch detection electrodes.

An example of a case where the touch detection electrodes in the capacitive touch panel, which is an example of the display device with an input function according to the present invention, are used as electrodes which are the matters used to specify the invention according to the present invention will be explained below with reference to FIG. 34 to FIG. 37. FIG. 34 is a diagram of a configuration example of the display device with a touch detection function according to the embodiments of the present invention. FIG. 35 is a diagram representing an example of a IV-IV cross-sectional structure of a main portion (portion B1) in FIG. 34. A portion B3 illustrated in FIG. 35 represents an example of the IV-IV cross-sectional structure of a portion B2 illustrated in FIG. 34. FIG. 36 is a perspective view representing a configuration example of driving electrodes and touch detection electrodes. The display device with a touch detection function is a so-called in-cell type device, using liquid-crystal display elements as display elements, in which a liquid crystal display device formed with the liquid crystal display elements and a capacitive-type touch detecting device are integrated.

A display device 1 with a touch detection function includes a pixel substrate 2, a counter substrate 3, an FPC 5, a liquid crystal layer 6, a seal 4, and a backlight BL. The backlight BL is an example of the illuminating unit 180.

As illustrated in FIG. 35, the pixel substrate 2 includes a TFT substrate 21 as a circuit board, a common electrode COML, and a pixel electrode EPIX. The TFT substrate 21 functions as a circuit board on which various electrodes and wirings, thin film transistors (TFT), and the like are formed. The TFT substrate 21 is formed with, for example, glass. An insulating film 22 is formed on the TFT substrate 21, and signal lines SGL are formed on the insulating film 22. A planarization film 23 formed of, for example, acrylic organic resin is formed on the signal lines SGL, and the common electrode COML is formed on the planarization film 23. The common electrode COML is an electrode for supplying a common voltage to a plurality of pixels Pix (not illustrated) and has translucency. The common electrode COML is also used as an electrode that applies an alternating current square waveform Sg in a touch sensor. In other words, the common electrode COML corresponds to the drive electrode of an input device that performs capacitive type touch detection. An insulating film 24 is formed on the common electrode COML, and the pixel electrode EPIX is formed on the insulating film 24. The pixel electrode EPIX is an electrode for supplying a pixel signal for display and has translucency. The common electrode COML and the pixel electrode EPIX are formed of, for example, indium tin oxide (ITO). An orientation film 25 is formed on the pixel electrode EPIX.

As illustrated in FIG. 35, the counter substrate 3 includes a glass substrate 31, a color filter 32, and a touch detection electrode TDL. The color filter 32 is formed on one face of the glass substrate 31. The color filter 32 is configured to periodically array color filter layers in three colors of, for example, red (R), green (G), and blue (B) together with a black matrix, and a set of the three colors of R, G, and B is associated with each of display pixels. A planarization film 33 formed of, for example, acrylic organic resin is formed on the color filter 32, and an orientation film 34 is formed on the planarization film 33. The touch detection electrode TDL is formed on the other face of the glass substrate 31 so as to extend in one direction. The touch detection electrode TDL is an electrode that outputs a touch detection signal Vdet in the touch sensor. The touch detection electrode TDL is an electrode formed of, for example, ITO and has translucency. A terminal portion PAD as illustrated in FIG. 34 is formed on the touch detection electrode TDL, which is coupled to the FPC 5 through the terminal portion PAD.

The FPC 5 is a flexible printed circuit board for extracting the touch detection signal Vdet of the touch detection electrode TDL to the outside. The FPC 5 is disposed in one side of the counter substrate 3 and is coupled to the touch detection electrode TDL through the terminal portion PAD. The FPC 5 is coupled to the detecting unit 120, a touch detection circuit 320 or a fixed potential 330 through, for example, a switch 311 explained later. The FPC 5 is also coupled to the applying unit 110 through, for example, a switch 312 explained later (see FIG. 37).

The liquid crystal layer 6 functions as a display function layer and modulates the light passing therethrough according to the state of an electric field. The electric field is formed by a potential difference between a voltage of the common electrode COML and a voltage of the pixel electrode EPIX. The liquid crystal in the horizontal electric field mode such as in-plane switching (IPS) is used for the liquid crystal layer 6.

The seal 4 is used to seal the liquid crystal layer 6 between the pixel substrate 2 and the counter substrate 3. As the material of the seal 4, for example, epoxy resin is used. The seal 4 is formed in an outer edge portion 41 of the pixel substrate 2 and the counter substrate 3.

The backlight BL is used to irradiate light from the side of the pixel substrate 2 to a display area where the liquid crystal layer 6 is provided. The backlight BL includes, for example, a plurality of light-emitting diodes (LEDs) and a light guide plate. The lights emitted from the LEDs are guided by the light guide plate so as to emit lights from a surface area.

Figure 37:
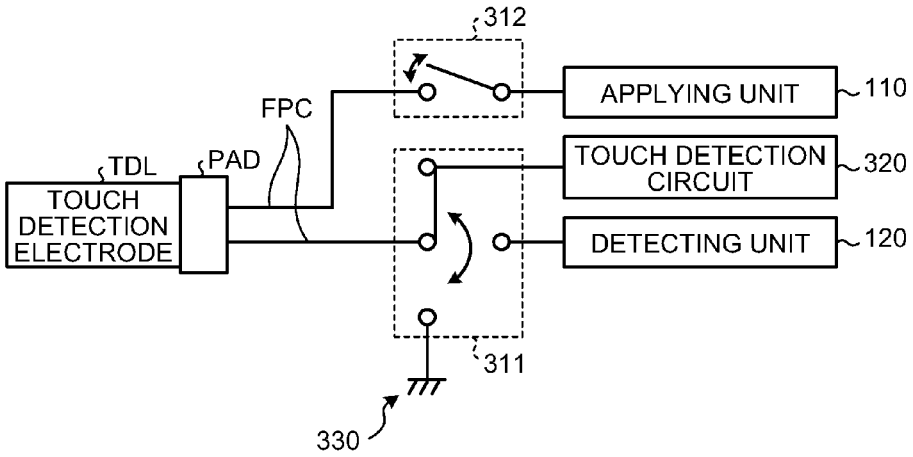
FIG. 37 is a diagram of a configuration example of electrical coupling to a touch detection electrode TDL.

FIG. 37 is a diagram of a configuration example of electrical coupling to the touch detection electrode TDL. FIG. 37 depicts only electrical coupling related to one touch detection electrode TDL; however, the electrical coupling is common to all the touch detection electrodes TDL used for processing related to the temperature. The switch 311 selectively couples any one of the detecting unit 120, the touch detection circuit 320, and the fixed potential 330 to the touch detection electrode TDL coupled thereto via the FPC 5 and the terminal portion PAD. The switch 312 switches between coupling of the applying unit 110 to the touch detection electrode TDL coupled thereto via the FPC 5 and the terminal portion PAD and non-coupling. The switch 312 couples the applying unit 110 to the touch detection electrode TDL only when, for example, the detecting unit 120 is coupled to the touch detection electrode TDL by the switch 311, and does not couple the applying unit 110 thereto in the other cases. The switch 311 and the switch 312 are coupled to the touch detection electrode TDL as electrically independent wirings via the FPC 5 and the terminal portion PAD. By using the switch 311 and the switch 312, it is possible to couple the touch detection circuit 320 to the touch detection electrode TDL when the touch detection circuit 320 performs touch detection, and to couple the applying unit 110 and the detecting unit 120 to the touch detection electrode TDL when the processing for the temperature of the touch detection electrode TDL is performed. By coupling the fixed potential 330 to the touch detection electrode TDL using the switch 311, electric changes of the touch detection electrodes TDL due to the processing for the touch detection and the temperature can be reset, and this configuration can serve as a shield electrode that shields the influence of static electricity over the display surface affected on the display device.

Of the display device 1 with a touch detection function, the drive electrode (for example, common electrode COML), the touch detection electrode TDL, and the touch detection circuit 320 function as an input device. By coupling the applying unit 110 and the detecting unit 120 illustrated in FIG. 37 to the input device and combining the function of the executing unit 136 (e.g., control unit 130) explained in the embodiments with the input device, this input device functions as the input device according to the present invention.

The display device 1 with a touch detection function as explained above is only an example of the configuration having a touch detection electrode that also functions as a shield electrode. The embodiment is not limited to the touch detection electrode and the shield electrode that can be shared as the electrode according to the present invention, and specific aspects thereof can be modified appropriately. For example, even if the electrodes arranged as the touch detection electrodes TDL do not have the touch detection function and are used as the shield electrodes, the shield electrode and the electrode related to acquisition of the temperature information can be shared. The electrodes having the shape as the electrodes 215 forming the present invention may be adopted as a shape of the touch detection electrodes TDL. The switches 312 and 314 may be omitted, and the applying unit 110 may be coupled to the common electrode COML.

Figure 38:
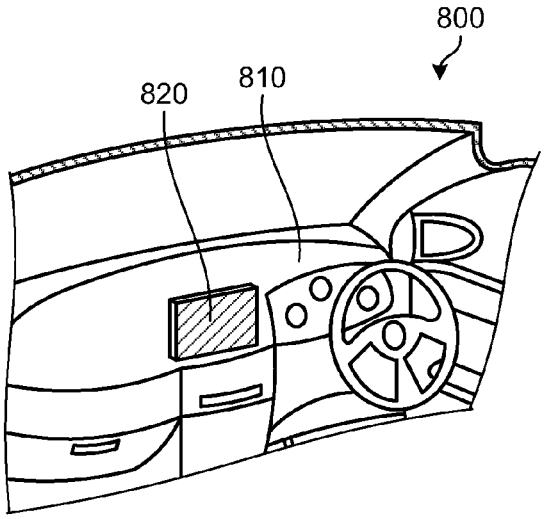
FIG. 38 is a diagram illustrating an example of an appearance of a car-mounted display device to which a display device with an input function according to the present invention is applied.

FIG. 38 is a diagram illustrating an example of an appearance of a car-mounted display device 820 to which the display device with an input function according to the present invention is applied. The car-mounted display device 820 is provided, for example, at a predetermined position in a dashboard 810 of a car 800. The car-mounted display device 820 is formed with, for example, the display device 1 with a touch detection function.

Application Example 3

Figure 39:
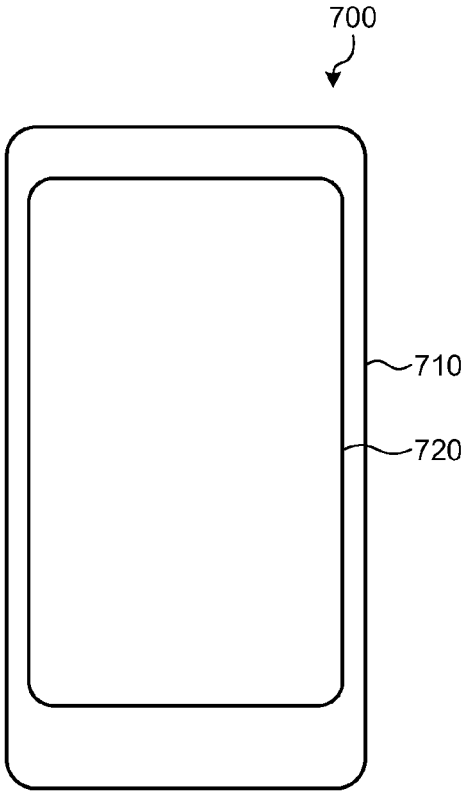
FIG. 39 is a diagram illustrating an example of an appearance of a smartphone to which the display device with an input function according to the present invention is applied.

FIG. 39 is a diagram illustrating an example of an appearance of a smartphone 700 to which the display device with an input function according to the present invention is applied. The smartphone 700 includes a display device 720 provided on, for example, one face of a housing 710 thereof. The display device 720 is formed with, for example, the display device 1 with a touch detection function.

5. Other

In the embodiments, the liquid crystal display device is exemplified as a disclosure example; however, as other application examples, there are all types of flat-panel display devices such as an organic electro-luminescence (OEL) display device, other self-luminous display devices, or an electronic paper display device including an electrophoretic element and the like. It is obvious that the display device can be applied to those from small and medium-sized display devices to large-sized display devices without limiting in particular.

The material of the electrodes provided as one component of the present invention is not limited to ITO. The electrodes may be metal electrodes formed of, for example, copper (Cu). The electrical characteristics of an electrical resistance value or the like of the electrodes change according to the material forming the electrodes. When a lower-resistance material is used for the electrode, the time constant of a circuit including the electrodes becomes lower. In this case, the time capable of detecting the electrical change due to the electric signal applied from the applying unit 110 becomes shorter. Therefore, the time resolution of the detecting unit 120 for detecting the electrical change is preferably determined according to the material of the electrodes.

Although the electrodes 215 have a symmetric form with respect to the X direction, this form is only an example, and the embodiment is not limited thereto. It may be asymmetric.

In the second and the third embodiments, the number of portions in the electrodes 215 is three when it is determined that the temperatures of the electrodes 215 are "Uniform"; however, this is only an example, and the number is not limited thereto. An arbitrary number of portions can be set as two or more. The temperature distribution model data 242 (or the resistance distribution model data 342) is data representing electrical changes according to the number of portions as a target of the set "Uniform". Specifically, the portions may be divided into, for example, five portions in more detail than the embodiments (e.g., "Right End", "Right closer to Middle", "Middle", "Left closer to Middle", and "Left End"). Moreover, the range of "Uniform" and the range of "Local" can be also arbitrarily set. Specifically, for example, when the temperatures of two or less portions among the five portions are high, this case may be determined as "Local", while when the temperatures of three or more portions are substantially the same as each other or when a difference between the temperatures is within a predetermined range (e.g., within 1° C.), then this case may be determined as "Uniform".

Figure 40:
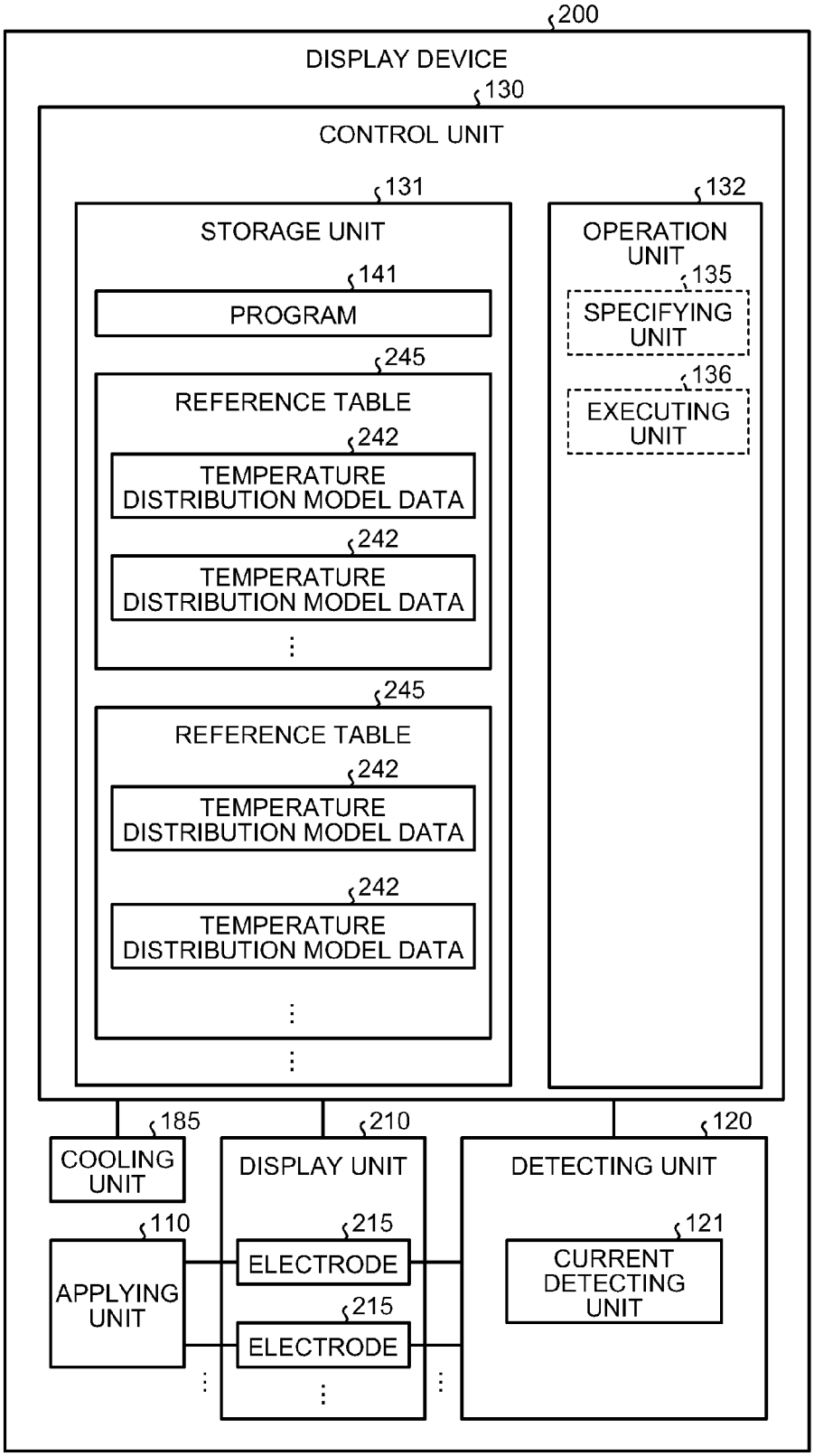
FIG. 40 is a block diagram of a configuration related to main functions of a display device further including a cooling unit.

The command in the embodiments is only an example, and the embodiment is not therefore limited thereto. FIG. 40 is a block diagram of a configuration related to main functions of a display device 200 further including a cooling unit 185. For example, the cooling unit 185 may further be provided in the second embodiment to further execute the command (operation of the cooling unit 185) similar to that of the third embodiment, or to execute the command (to terminate the operation of the display unit 210) according to the second embodiment further in the third embodiment. When part of the electrodes 215 exceeds a predetermined temperature (e.g., 100° C.), it may be configured to switch the display content in the display area of the portion corresponding to the part of the electrodes 215 to a predetermined content (e.g., monochrome display). Thereafter, by maintaining the display content of this portion in the predetermined content, it is possible to prevent occurrence of disturbance in the display content that may possibly occur according to the switching of the display content at the high temperature. By performing normal display in other portions of the display area, the display device can be continuously operated. Moreover, the luminance of the backlight (light source 212) of the display unit 210 may be decreased stepwise according to an increase in the temperature instead of the command to terminate the display by the display unit 210. This makes it possible to indicate that it is becoming difficult to ensure the normal operating environment of the display device with an increase in the temperature. For the strength of the cooling by the cooling unit 185, the level of the strength may also be changed stepwise in the same manner as above. In addition, it may be configured to enable individual control of the backlight in units corresponding to a specific resolution (subdivision of the range) of the temperature distribution using the electrodes 215 and to output the command as a target of control only for the backlight at a portion where the temperature increases, to the executing unit 136. For a cooling portion by the cooling unit 185, a configuration (e.g., a wind collector and a wind direction change unit) to locally cool the portion where the temperature increases may also be provided. For example, when a warning unit that gives a warning with a sound or the like is provided, and if part or all of the electrodes 215 exceeds a certain temperature (e.g., 100° C.), a warning with a sound may be issued.

In the second embodiment and other embodiments, it is mentioned that the dielectric is contained in the adhesive layer 214; however, this is only an example, and the embodiment is not therefore limited thereto. For example, by forming a cover layer on the face of the polarizer 213 on the side, where the electrodes 215 are provided, with acrylic resin having coating properties, the same effects can be obtained.

The control unit 130 that functions as the specifying unit 135 and the executing unit in the embodiments performs so-called software processing in which the operation unit 132 reads the program from the storage unit 131 and performs execution thereof. However, this is only an example of implementation of the specifying unit 135, and the embodiment is not limited thereto. The control unit 130 may be hardware like an integrated circuit such as an application specific integrated circuit (ASIC). Moreover, the specifying unit 135 and the executing unit 136 may be separately provided.

The face as a target for acquisition of the temperature information is not limited to the display surface of the liquid crystal display. For example, the face may be a substrate. In other words, the electrodes used to acquire the temperature information based on the electrical changes may be formed by some other configuration having the substrate or some other face as well as the display surface of the liquid crystal display.

The electrodes used to acquire the temperature information based on the electrical changes may be arranged in a matrix, as well as be arranged in parallel in one direction, or may be arranged on steps at an interval, or may be arranged only in a partial area of the structure having a face as the display surface.

For some other effects derived from the aspects mentioned in the present embodiment, those which are apparent from the description of the present specification and those which can be thought of by persons skilled in the art are obviously understood as those derived from the present invention.

The present disclosure can adopt, for example, the following configuration.

1. A display device including:

a display unit that displays an image;

an illuminating unit that irradiates light to the display unit;

a plurality of electrodes that are arranged in parallel in a predetermined one direction along a display surface of the display unit;

an applying unit that applies an electric signal to the electrodes;

a detecting unit that detects electrical changes of the electrodes occurring due to the electric signal; and a control unit that controls the display unit or the illuminating unit based on temperature information for the electrodes indicated by the electrical changes.

2. A temperature information acquiring device including:

a plurality of electrodes that are arranged in parallel in a predetermined one direction;

an applying unit that applies an electric signal to the electrodes;

a detecting unit that detects electrical changes of the electrodes occurring due to the electric signal; and a specifying unit that specifies temperature information for each of the electrodes based on the electrical changes.

3. A temperature information acquiring method including:

applying an electric signal to a plurality of electrodes arranged in parallel in a predetermined one direction;

detecting electrical changes of the electrodes occurring due to the electric signal; and specifying temperature information for each of the electrodes based on the electrical changes.

For example, the following configuration can also be adopted based on the present disclosure.

4. An input device including:

a sensing unit that detects a contact operation or a proximity operation performed on a predetermined surface area as an input operation;

a plurality of electrodes that are arranged in parallel in a predetermined one direction along the surface area;

an applying unit that applies an electric signal to the electrodes;

a detecting unit that detects electrical changes of the electrodes occurring due to the electric signal; and an executing unit that executes a command based on temperatures of the electrodes indicated by the electrical changes.

5. A display device with an input function including:

a display unit that displays an image;

a sensing unit that detects a contact operation or a proximity operation performed on a display surface of the display unit as an input operation;

a plurality of electrodes that are arranged in parallel in a predetermined one direction along the display surface;

an applying unit that applies an electric signal to the electrodes;

a detecting unit that detects electrical changes of the electrodes occurring due to the electric signal; and an executing unit that executes a command based on temperatures of the electrodes indicated by the electrical changes.

What is claimed is:

1. A display device comprising:

a display unit having a display area configured to display an image;

an illuminating unit configured to irradiate the display unit with light;

a plurality of electrodes that are arranged in a first predetermined direction on the display unit;

an applying unit configured to apply an electric signal to the plurality of electrodes;

a detecting unit configured to detect electrical changes of the plurality of electrodes occurring due to the electric signal, the electrical changes including a first electrical change and a second electrical change; and a control unit configured to control at least one of the display unit or the illuminating unit based on temperature information of the plurality of electrodes indicated by the electrical changes, the temperature information including a first temperature distribution and a second temperature distribution, wherein each of the plurality of electrodes includes a plurality of extension portions that extend in a second predetermined direction traversing the first predetermined direction, and the control unit is configured to specify the first temperature distribution in the first predetermined direction according to the first electrical change of the plurality of electrodes, select a first electrode from the plurality of electrodes, the first electrode having the first electrical change that is a predetermined threshold or higher, and specify the second temperature distribution in the second predetermined direction of the first electrode according to the second electrical change.

2. The display device according to claim 1, wherein the first electrical change is a change in an equilibrium current value or a change in an equilibrium voltage value of one of the plurality of electrodes in an electric signal applied state.

3. The display device according to claim 1, wherein the second electrical change is a change in a current value or a change in a voltage value occurring when one of the plurality of electrodes is shifted from an electric signal applied state to a non-applied state.

4. The display device according to claim 1, wherein a separation between two of the plurality of extension portions in the first predetermined direction is configured to store an electric charge between the two of the plurality of extension portions.

5. The display device according to claim 1, wherein a dielectric is interposed between the plurality of extension portions.

6. The display device according to claim 1, wherein one or more of the plurality of electrodes are transparent electrodes.

7. A temperature information acquisition device comprising:

a plurality of electrodes that are arranged in a first predetermined direction on a display unit of a display device, the display unit having a display area;

an applying unit configured to apply an electric signal to the plurality of electrodes;

a detecting unit configured to detect electrical changes of the plurality of electrodes occurring due to the electric signal, the electrical changes including a first electrical change and a second electrical change; and a specifying unit configured to specify temperature information for each of the plurality of electrodes based on the electrical changes, the temperature information including a first temperature distribution and a second temperature distribution, wherein the each of the plurality of electrodes includes a plurality of extension portions that extend in a second predetermined direction traversing the first predetermined direction, and the specifying unit is configured to specify the first temperature distribution in the first predetermined direction according to the first electrical change of the plurality of electrodes, select a first electrode from the plurality of electrodes, the first electrode having the first electrical change that is a predetermined threshold or higher, and specify the second temperature distribution in the second predetermined direction of the first electrode according to the second electrical change.

8. A temperature information acquisition method, the method comprising:

applying an electric signal to a plurality of electrodes that are arranged in a first predetermined direction on a display unit, the display unit having a display area, each of the plurality of electrodes includes a plurality of extension portions that extend in a second predetermined direction traversing the first predetermined direction;

detecting electrical changes of the plurality of electrodes occurring due to the electric signal, the electrical changes including a first electrical change and a second electrical change; and specifying temperature information for the each of the plurality of electrodes based on the electrical changes, the temperature information including a first temperature distribution and a second temperature distribution;

specifying the first temperature distribution in the first predetermined direction according to the first electrical change of the plurality of electrodes;

selecting a first electrode from the plurality of electrodes, the first electrode having the first electrical change that is a predetermined threshold or higher; and specifying the second temperature distribution in the second predetermined direction of the first electrode according to the second electrical change.

9. The temperature information acquisition device according to claim 7, wherein the first electrical change is a change in an equilibrium current value or a change in an equilibrium voltage value of one of the plurality of electrodes in an electric signal applied state.

10. The temperature information acquisition device according to claim 7, wherein the second electrical change is a change in a current value or a change in a voltage value when one of the plurality of electrodes is shifted from an electric signal applied state to a non-applied state.

11. The temperature information acquisition device according to claim 7, wherein a separation between two of the plurality of extension portions in the first predetermined direction is configured to store an electric charge between the two of the plurality of extension portions.

12. The temperature information acquisition device according to claim 7, wherein a dielectric is interposed between the plurality of extension portions.

13. The temperature information acquisition device according to claim 7, wherein one or more of the plurality of electrodes are transparent electrodes.

14. The display device according to claim 1, wherein the plurality of electrodes are entirely disposed in the display area.

15. The temperature information acquisition device according to claim 7, wherein the plurality of electrodes are entirely disposed in the display area.

16. The temperature information acquisition method according to claim 8, wherein the plurality of electrodes are entirely disposed in the display area.

17. The display device according to claim 1, wherein the each of the plurality of electrodes includes one or more coupling portions, and wherein the one or more coupling portions couple first ends of two or more of the plurality of extension portions to each other.

18. The temperature information acquisition device according to claim 7, wherein the each of the plurality of electrodes includes one or more coupling portions, and wherein the one or more coupling portions couple first ends of two or more of the plurality of extension portions to each other.

19. The temperature information acquisition method according to claim 8, wherein the each of the plurality of electrodes includes one or more coupling portions, and wherein the one or more coupling portions couple first ends of two or more of the plurality of extension portions to each other.

* * * * *